US006621398B2

(12) United States Patent
Fujiwara et al.

(10) Patent No.: US 6,621,398 B2
(45) Date of Patent: Sep. 16, 2003

(54) MAGNETIC CORE COMPRISING A BOND MAGNET INCLUDING MAGNETIC POWDER WHOSE PARTICLE'S SURFACE IS COATED WITH OXIDATION-RESISTANT METAL

(75) Inventors: Teruhiko Fujiwara, Sendai (JP); Masayoshi Ishii, Sendai (JP); Haruki Hoshi, Sendai (JP); Keita Isogai, Sendai (JP); Hatsuo Matsumoto, Sendai (JP); Toru Ito, Miyagi (JP); Tamiko Ambo, Tokyo (JP)

(73) Assignee: NEC Tokin Corporation, Sendai (JP)

( * ) Notice: Subject to any disclaimer, the term of this patent is extended or adjusted under 35 U.S.C. 154(b) by 28 days.

(21) Appl. No.: 09/996,047

(22) Filed: Nov. 28, 2001

(65) Prior Publication Data

US 2002/0109571 A1 Aug. 15, 2002

(30) Foreign Application Priority Data

| | | |
|---|---|---|
| Nov. 28, 2000 | (JP) | 2000/361289 |
| Nov. 28, 2000 | (JP) | 2000/361645 |
| Jan. 29, 2001 | (JP) | 2001/019647 |
| Apr. 17, 2001 | (JP) | 2001/117665 |

(51) Int. Cl.[7] ..... H01F 1/18

(52) U.S. Cl. ..... 336/178; 336/83; 148/300; 148/301

(58) Field of Search ..... 336/83, 178, 110; 428/328, 323; 148/300, 301

(56) References Cited

U.S. PATENT DOCUMENTS 6,432,158 B1 * 8/2002 Harada et al. ..... 75/245

FOREIGN PATENT DOCUMENTS

| | | | |
|---|---|---|---|
| JP | 50-133453 | | 10/1975 |
| JP | 4102425 | * | 9/1998 |
| JP | 2002-164223 | * | 7/2002 |

* cited by examiner

*Primary Examiner*—Anh Mai
(74) *Attorney, Agent, or Firm*—Frishauf, Holtz, Goodman & Chick, P.C.

(57) ABSTRACT

Disposed in a magnetic gap of a magnetic core, a magnetically biasing permanent magnet is a bond magnet comprising rare-earth magnetic powder and a binder resin. The rare-earth magnetic powder has an intrinsic coercive force of 5 kOe or more, a Curie temperature of 300° C. or more, and an average particle size of 2.0–50 $\mu$m. The rare-earth magnetic power has a surface coated with a metallic layer containing an oxidation-resistant metal. In order to enable a surface-mount to reflow, the rare-earth magnetic powder may have the intrinsic coercive force of 10 kOe or more, the Curie temperature of 500° C. and the average particle size of 2.5–50 $\mu$m. In addition, to prevent specific resistance from degrading, the metallic layer desirably may be coated with a glass layer consisting of low-melting glass having a softening point less than a melting point of the oxidation-resistant metal.

30 Claims, 37 Drawing Sheets

MAGNETIC CORE COMPRISING A BOND MAGNET INCLUDING MAGNETIC POWDER WHOSE PARTICLE'S SURFACE IS COATED WITH OXIDATION-RESISTANT METAL

BACKGROUND OF THE INVENTION

This invention relates to a magnetic core (which will hereinunder be often referred to as "core" simply) which is used in an inductance element such as a choke coil and a transformer for use in a switching power supply or the like and, in particular, to a magnetic core comprising a permanent magnet for magnetically biasing.

In a choke coke and a transformer used in, for example, a switching power supply or the like, a voltage is usually applied thereto with an AC component superposed to a DC component. Therefore, a magnetic core used in those choke coil and transformer is required to have a magnetic characteristic of a good magnetic permeability so that the core is not magnetically saturated by the superposition of the DC component. This magnetic characteristic will be referred to as "DC superposition characteristic" or simply "superposition characteristic" in the art.

As magnetic cores in application fields within high frequency bands, there have been used a ferrite magnetic core and a dust magnetic core. These magnetic cores have individual features due to physical properties of their materials. That is, the ferrite magnetic core has a high intrinsic magnetic permeability and a low saturated magnetic flux density while the dust magnetic core has a low intrinsic magnetic permeability and a high saturated magnetic flux density. Accordingly, the dust magnetic core is often used as one having a toroidal shape. On the other hand, the ferrite magnetic core has an E-shape core part having a central leg formed with a magnetic gap so as to prevent magnetic saturation from being caused by the superposition of the DC component.

Recently, since electronic parts are required to be small-sized as electronic devices are more compact-sized, the magnetic core with the magnetic gap is small-sized too. So, there is a strong demand for magnetic cores having an increased magnetic permeability against superposition of DC component.

Generally, it is necessary for the demand to select a magnetic core having a high saturation magnetization, that is, to select a magnetic core that is not magnetically saturated by a high magnetic field applied. However, the saturation magnetization is inevitably determined by materials and cannot be made as high as desired.

As a solution, it has been conventionally proposed to dispose a permanent magnet in a magnetic gap formed in a magnetic path of a magnetic core, that is, to magnetically bias the magnetic core, to thereby cancel a DC magnetic flux caused by the superposition of DC component.

The magnetic bias by use of the permanent magnet is a good solution to improve the DC superposition characteristic. However, this method have hardly been brought into a practical use for reasons as follows. More specifically, use of a sintered metallic magnet resulted in considerable increase of a core loss of the magnetic core. In addition, use of a ferrite magnet led in unstable superposition characteristic.

Means to resolve the problems is disclosed, for example, in Japanese Unexamined Patent Publication No. S50-133453 or JP 50-133453 A. This Publication uses, as a magnetically biasing magnet, a bond magnet comprising rare-earth magnetic powder with a high magnetic coercive force and binder which are mixed together with each other and compacted into a shape. Thereby, the DC superposition characteristic and temperature elevation of the core are improved.

Recently, a power supply has been more and more strongly required to improve its power transformation efficiency. Accordingly, this requirement has been became to a high level that it is difficult to determine good and bad of magnetic cores for choke coils and transformers by core temperatures measured. It is therefore inevitable to determine it from core loss data measured by use of a core-loss measuring device. According to the study by the present inventors, it was confirmed that the core loss has a degraded value in cores having the resistance value disclosed in JP 50-133453 A.

SUMMARY OF THE INVENTION

It is therefore a first object of this invention to provide, in a magnetic core which has at least one magnetic gap formed in a magnetic path and which comprises a magnetically biasing magnet disposed in the vicinity of the magnetic gap for providing a magnetic bias from opposite ends of the magnetic gap to the core, easily and cheaply the magnetic core having an excellent DC superposition characteristic and an excellent core-loss characteristic in consideration of the above description.

In addition, there have recently been demands for coil parts of a surface-mounted type. Those coil parts are subjected to reflow soldering process so as to be surface-mounted on a circuit board. It is desired that a magnetic core of the coil part be not degraded in its magnetic properties under conditions of the reflow soldering process. Further, an oxidation-resistant rare-earth magnet is indispensable.

It is a second object of this invention to provide, in a magnetic core which has at least one magnetic gap formed in a magnetic path and which comprises a magnetically biasing magnet disposed in the vicinity of the magnetic gap for providing a magnetic bias from opposite ends of the magnetic gap to the core, easily and cheaply the magnetic core which has an excellent DC superposition characteristic, an excellent core-loss characteristic, and oxidation resistance without affecting the characteristics under conditions of the reflow soldering process in consideration of the above description.

Furthermore, it is desired that not only magnetic powder has an improved oxidation resistance but also a rare-earth magnet has a high specific resistance.

It is a third object of this invention to provide, in a magnetic core which has at least one magnetic gap formed in a magnetic path and which comprises a magnetically biasing magnet disposed in the vicinity of the magnetic gap for providing a magnetic bias from opposite ends of the magnetic gap to the core, easily and cheaply the magnetic core which has an excellent DC superposition characteristic, an excellent core-loss characteristic, oxidation resistance, and a high specific resistance in consideration of the above description.

According to a first aspect of this invention, in order to achieve the above-mentioned first object in a magnetic core which has at least one magnetic gap formed in a magnetic path and which comprises a magnetically biasing magnet disposed in the vicinity of the magnetic gap for providing a magnetic bias from opposite ends of the magnetic gap to the core, there is provided the magnetic core comprising the magnetically biasing magnet, wherein the magnetically biasing magnet comprises a bond magnet comprising rare-earth magnetic powder and a binder resin, the rare-earth magnetic powder has an intrinsic coercive force of 5 kOe or more, a Curie temperature of 300° C. or more, and an average particle size of 2.0–50 μm, and the rare-earth magnetic powder consists of an aggregation of magnetic particles surfaced with a coating of a metallic layer containing an oxidation-resistant metal.

Preferably, the oxidation-resistant metal may be, for example, at least one metal or alloy thereof selected from a group of zinc, aluminum, bismuth, gallium, indium, magnesium, lead, antimony, tin.

Preferably, the bond magnet may comprise the binder resin content thereof which is 20% or more on the base of a volumetric percentage and the bond magnet may have a specific resistance of 1 Ω·cm or more. The binder resin may be polyamideimide resin.

In addition, the magnetic powder preferably may comprise the oxidation-resistant metal content thereof which is 0.1–10% on the base of a volumetric percentage.

Furthermore, it is possible to obtain an inductance part by winding at least one winding by one or more turns on the above-mentioned magnetic core comprising the magnetically biasing magnet.

In addition, the inductance part includes a coil, a choke coil, a transformer, and other parts each of which generally essentially comprises a core and winding or windings.

According to a second aspect of this invention, in order to achieve the above-mentioned second object in a magnetic core which has at least one magnetic gap formed in a magnetic path and which comprises a magnetically biasing magnet disposed in the vicinity of the magnetic gap for providing a magnetic bias from opposite ends of the magnetic gap to the core, there is provided the magnetic core comprising the magnetically biasing magnet, wherein the magnetically biasing magnet comprises a bond magnet which comprises rare-earth magnetic powder and a binder resin, the rare-earth magnetic powder has an intrinsic coercive force of 10 kOe or more, a Curie temperature of 500° C. or more, and an average particle size of 2.5–50 μm, and the rare-earth magnetic power consists of an aggregation of magnetic particles surfaced with a coating of a metallic layer containing an oxidation-resistant metal.

Preferably, the oxidation-resistant metal may be, for example, at least one metal or alloy thereof selected from a group of zinc, aluminum, bismuth, gallium, indium, magnesium, lead, antimony, tin.

Preferably, the bond magnet may comprise the binder resin content thereof which is 30% or more on the base of a volumetric percentage and the bond magnet may have a specific resistance of 1 Ω·cm or more. The binder resin may be polyamideimide resin.

In addition, the magnetic powder preferably may comprise the oxidation-resistant metal content thereof which is 0.1–10% on the base of a volumetric percentage.

Furthermore, it is possible to obtain an inductance part by winding at least one winding by one or more turns on the above-mentioned magnetic core comprising the magnetically biasing magnet.

In addition, the inductance part includes a coil, a choke coil, a transformer, and other parts each of which generally essentially comprises a core and winding or windings.

According to a third aspect of this invention, in order to achieve the above-mentioned third object in a magnetic core which has at least one magnetic gap formed in a magnetic path and which comprises a magnetically biasing magnet disposed in the vicinity of the magnetic gap for providing a magnetic bias from opposite ends of the magnetic gap to the core, there is provided the magnetic core comprising the magnetically biasing magnet, wherein the magnetically biasing magnet comprises a bond magnet which comprises rare-earth magnetic powder and a binder resin, the rare-earth magnetic powder has an intrinsic coercive force of 10 kOe or more, a Curie temperature of 500° C. or more, and an average particle size of 2.5–50 μm, the bond magnet comprises the binder resin content thereof which is 30% or more on the base of a volumetric percentage, the bond magnet has a specific resistance of 1 Ω·cm or more, and the rare-earth magnetic power consists of an aggregation of magnetic particles surfaced with a coating of a metallic layer containing an oxidation-resistant metal, the metallic layer is surfaced with a coating of a glass layer consisting of low-melting glass having a softening point which is lower than a melting point of the oxidation-resistant metal.

Preferably, the oxidation-resistant metal may be, for example, at least one metal or alloy thereof selected from a group of zinc, aluminum, bismuth, gallium, indium, magnesium, lead, antimony, tin.

Preferably, the magnetic powder may comprise the oxidation-resistant metal and the said low-melting glass total content thereof which is 0.1–10% on the base of a volumetric percentage. The said binder resin may be polyamideimide resin.

Furthermore, it is possible to obtain an inductance part by winding at least one winding by one or more turns on the above-mentioned magnetic core comprising the magnetically biasing magnet.

In addition, the inductance part includes a coil, a choke coil, a transformer, and other parts each of which generally essentially comprises a core and winding or windings.

The present co-inventors first studied a permanent magnet to be inserted to achieve the above-mentioned first object of this invention. The co-inventors resultantly obtained a knowledge that a use of a permanent magnet having a specific resistance of 1 Ω·cm or more and an intrinsic coercive force iHc of 5 kOe or more can provide a magnetic core which has an excellent DC superposition characteristic and a non-degraded core-loss characteristic. This means that the property of the magnet necessary for obtaining an excellent DC superposition characteristic is the intrinsic coercive force rather than the energy product. Thus, this invention is based on the findings that it is possible to provide a sufficient high DC superposition characteristic if a permanent magnet has a high intrinsic coercive force although the permanent magnet having a high specific resistance is used.

The permanent magnet having a high specific resistance and a high intrinsic coercive force can be generally realized by a rare-earth bond magnet which is formed of rare-earth magnetic powder and a binder mixed together, then compacted. However, the magnetic powder used may be any kind of magnetic powder having a high coercive force. The rare-earth magnetic powder includes SmCo series, NdFeB series, SmFeN series, and other.

A magnetic core for a choke coil or a transformer can be effectively made of any kind of materials which have a soft magnetism. Generally speaking, the materials include ferrite of MnZn series or NiZn series, dust magnetic core, silicon steel plate, amorphous or others. Further, the magnetic core is not limited to a special shape but this invention can be applicable to a magnetic core having a different shape such as toroidal core, E-E core, E-l core or others. Each of these magnetic cores has at least one magnetic gap in its magnetic path in which gap the permanent magnet is disposed.

Although the gap is not restricted in a length thereof, the DC superposition characteristic is degraded when the gap length is excessively small. When the gap length is, on the other hand, excessively large, the permeability is lowered. Accordingly, the gap length is determined automatically. Although it is easily possible to obtain a bias effect if a magnetically biasing permanent magnet has a larger thickness, the magnetically biasing permanent magnet preferably may have a smaller thickness for miniaturization of a magnetic core. However, it is difficult to obtain a sufficient magnetic bias if the thickness of the magnetically biasing permanent magnet is smaller than 50 $\mu$m. Accordingly, a length of 50 $\mu$m or more is required for the magnetic gap in which the magnetically biasing permanent magnet is disposed and a length of 10000 $\mu$m or less may be preferable in respect of restraint of a size in the core.

As regards a requirement character for a permanent magnet inserted in a magnetic gap, an intrinsic coercive force of 5 kOe or more is required. This is because a coercive force disappears caused by a DC magnetic field applied to a magnetic core if the intrinsic coercive force is 5 kOe or less. In addition, although a specific resistance preferably may be high, degradation of a core-loss is not caused by the specific resistance if the specific resistance has 1 Ω·cm or more. In addition, the average particle size of the magnetic powder is desired 50 $\mu$m or less at the maximum because the use of the magnetic powder having the average particle size larger than 50 $\mu$m results in degradation of the core-loss characteristic. While the minimum value of the average particle size is required 2.0 $\mu$m or more because the powder having the average particle size less than 2.0 $\mu$m is significant in magnetization reduction due to oxidation of particle caused by grinding.

Herein, in order to improve oxidation resistance in magnetic powder, the magnetic powder desirably may consist of an aggregation of magnetic particles surfaced with a coating of an oxidation-resistant metal which is at least one metal or alloy thereof selected from a group of zinc, aluminum, bismuth, gallium, indium, magnesium, lead, antimony, tin. It is possible to obtain a magnetic core which copes with both oxidation resistance and a high DC superposition characteristic if the amount of the oxidation-resistant metal lies between 0.1–10% on the base of volumetric percentage.

In addition, the present co-inventors studied a permanent magnet to be inserted to achieve the above-mentioned second object of this invention. The co-inventors resultantly obtained a knowledge that a use of a permanent magnet having a specific resistance of 1 Ω·cm or more and an intrinsic coercive force iHc of 10 kOe or more can provide a magnetic core which has an excellent DC superposition characteristic and a non-degraded core-loss characteristic. This means that the property of the magnet necessary for obtaining an excellent DC superposition characteristic is the intrinsic coercive force rather than the energy product. Thus, this invention is based on the findings that it is possible to provide a sufficient high DC superposition characteristic if a permanent magnet has a high intrinsic coercive force although the permanent magnet having a high specific resistance is used.

The permanent magnet having a high specific resistance and a high intrinsic coercive force can be generally realized by a rare-earth bond magnet which is formed of rare-earth magnetic powder and a binder mixed together, then compacted. However, the magnetic powder used may be any kind of magnetic powder having a high coercive force. Although the rare-earth magnetic powder includes SmCo series, NdFeB series, SmFeN series, and other, in the present circumstances, it is restricted to $Sm_2Co_{17}$ series magnet because a magnet having a Curie temperature Tc of 500° C. and a coercive force of 10 kOe or more is required in consideration of conditions of the reflow soldering process and the oxidation resistance.

A magnetic core for a choke coil or a transformer can be effectively made of any kind of materials which have a soft magnetism. Generally speaking, the materials include ferrite of MnZn series or NiZn series, dust magnetic core, silicon steel plate, amorphous or others. Further, the magnetic core is not limited to a special shape but this invention can be applicable to a magnetic core having a different shape such as toroidal core, E-E core, E-l core or others. Each of these magnetic cores has at least one magnetic gap in its magnetic path in which gap the permanent magnet is disposed.

Although the gap is not restricted in a length thereof, the DC superposition characteristic is degraded when the gap length is excessively small. When the gap length is, on the other hand, excessively large, the permeability is lowered. Accordingly, the gap length is determined automatically. Although it is easily possible to obtain a bias effect if a magnetically biasing permanent magnet has a larger thickness, the magnetically biasing permanent magnet preferably may have a smaller thickness for miniaturization of a magnetic core. However, it is difficult to obtain a sufficient magnetic bias if the thickness of the magnetically biasing permanent magnet is smaller than 50 $\mu$m. Accordingly, a length of 50 $\mu$m or more is required for the magnetic gap in which the magnetically biasing permanent magnet is disposed and a length of 10000 $\mu$m or less may be preferable in respect of restraint of a size in the core.

As regards a requirement character for a permanent magnet inserted in a magnetic gap, an intrinsic coercive force of 10 kOe or more is required. This is because a coercive force disappears caused by a DC magnetic field applied to a magnetic core if the intrinsic coercive force is 10 kOe or less. In addition, although a specific resistance preferably may be high, degradation of a core-loss is not caused by the specific resistance if the specific resistance has 1 Ω·cm or more. In addition, the average particle size of the magnetic powder is desired 50 $\mu$m or less at the maximum because the use of the magnetic powder having the average particle size larger than 50 $\mu$m results in degradation of the core-loss characteristic. While the minimum value of the average particle size is required 2.5 $\mu$m or more because the powder having the average particle size less than 2.5 $\mu$m is significant in magnetization reduction due to oxidation of particle caused by grinding.

Herein, in order to improve oxidation resistance in magnetic powder, the magnetic powder desirably may consist of an aggregation of magnetic particles surfaced with a coating of an oxidation-resistant metal which is at least one metal or alloy thereof selected from a group of zinc, aluminum, bismuth, gallium, indium, magnesium, lead, antimony, tin. It is possible to obtain a magnetic core which copes with both oxidation resistance and a high DC superposition characteristic if the amount of the oxidation-resistant metal lies between 0.1–10% on the base of volumetric percent.

Furthermore, the present co-inventors studied a permanent magnet to be inserted to achieve the above-mentioned third object of this invention. The co-inventors resultantly obtained a knowledge that a use of a permanent magnet having a specific resistance of 1 Ω·cm or more and an intrinsic coercive force iHc of 10 kOe or more can provide a magnetic core which has an excellent DC superposition characteristic and a non-degraded core-loss characteristic. This means that the property of the magnet necessary for obtaining an excellent DC superposition characteristic is the intrinsic coercive force rather than the energy product. Thus, this invention is based on the findings that it is possible to provide a sufficient high DC superposition characteristic if a permanent magnet has a high intrinsic coercive force although the permanent magnet having a high specific resistance is used.

The permanent magnet having a high specific resistance and a high intrinsic coercive force can be generally realized by a rare-earth bond magnet which is formed of rare-earth magnetic powder and a binder mixed together, then compacted. However, the magnetic powder used may be any kind of magnetic powder having a high coercive force.

Although the rare-earth magnetic powder includes SmCo series, NdFeB series, SmFeN series, and other, in the present circumstances, it is restricted to $Sm_2Co_{17}$ series magnet because a magnet having a Curie temperature Tc of 500° C. and a coercive force of 10 kOe or more is required in consideration of conditions of the reflow soldering process and the oxidation resistance.

A magnetic core for a choke coil or a transformer can be effectively made of any kind of materials which have a soft magnetism. Generally speaking, the materials include ferrite of MnZn series or NiZn series, dust magnetic core, silicon steel plate, amorphous or others. Further, the magnetic core is not limited to a special shape but this invention can be applicable to a magnetic core having a different shape such as toroidal core, E-E core, E-l core or others. Each of these magnetic cores has at least one magnetic gap in its magnetic path in which gap the permanent magnet is disposed.

Although the gap is not restricted in a length thereof, the DC superposition characteristic is degraded when the gap length is excessively small. When the gap length is, on the other hand, excessively large, the permeability is lowered. Accordingly, the gap length is determined automatically.

As regards a requirement character for a permanent magnet inserted in a magnetic gap, an intrinsic coercive force of 10 kOe or more is required. This is because a coercive force disappears caused by a DC magnetic field applied to a magnetic core if the intrinsic coercive force is 10 kOe or less. In addition, although a specific resistance preferably may be high, degradation of a core-loss is not caused by the specific resistance if the specific resistance has 1 Ω·cm or more. In addition, the average particle size of the magnetic powder is desired 50 μm or less at the maximum because the use of the magnetic powder having the average particle size larger than 50 μm results in degradation of the core-loss characteristic. While the minimum value of the average particle size is required 2.5 μm or more because the powder having the average particle size less than 2.5 μm is significant in magnetization reduction due to oxidation of particle caused by grinding.

Herein, in order to improve oxidation resistance in magnetic powder, the magnetic powder desirably may consist of an aggregation of magnetic particles surfaced with a coating of an oxidation-resistant metal which is at least one metal or alloy thereof selected from a group of zinc, aluminum, bismuth, gallium, indium, magnesium, lead, antimony, tin. However, it seems obvious to those skilled in the art that it results in bringing on degradation of a specific resistance when the surface of each magnetic particle in the magnetic powder is coated with the oxidation-resistant metal. The specific resistance preferably may be high from the point of view of efficiency in a power supply and frequency characteristics in magnetic permeability μ. In order to improve the specific resistance, coating of the oxidation-resistant metal is surfaced with a coating of a low-melting glass having a softening point which is lower than a melting point of the oxidation-resistant metal in question. Thus, it is possible to obtain a magnetic core which copes with both a high specific resistance and oxidation resistance. The oxidation-resistant and the low-melting glass total content of the magnetic powder may be desired 0.1% or more on the base of volumetric percentage because oxidation resistance is substantially equivalent to additive-free if the oxidation-resistant and the low-melting glass total content of the magnetic powder is less than 0.1% on the base of volumetric percentage. In addition, the total content may be desired 10% or less on the base of volumetric percentage because the magnetic powder has a low packing factor and a decreased magnetic flux if the total content is more than 10%. Accordingly, it is possible to obtain a magnetic core which copes with both oxidation resistance and a high specific resistance when the oxidation-resistant and the low-melting glass total content of the magnetic powder lies between 0.1–10% on the base of volumetric percentage.

DETAILED DESCRIPTION OF THE INVENTION

Figure 1:
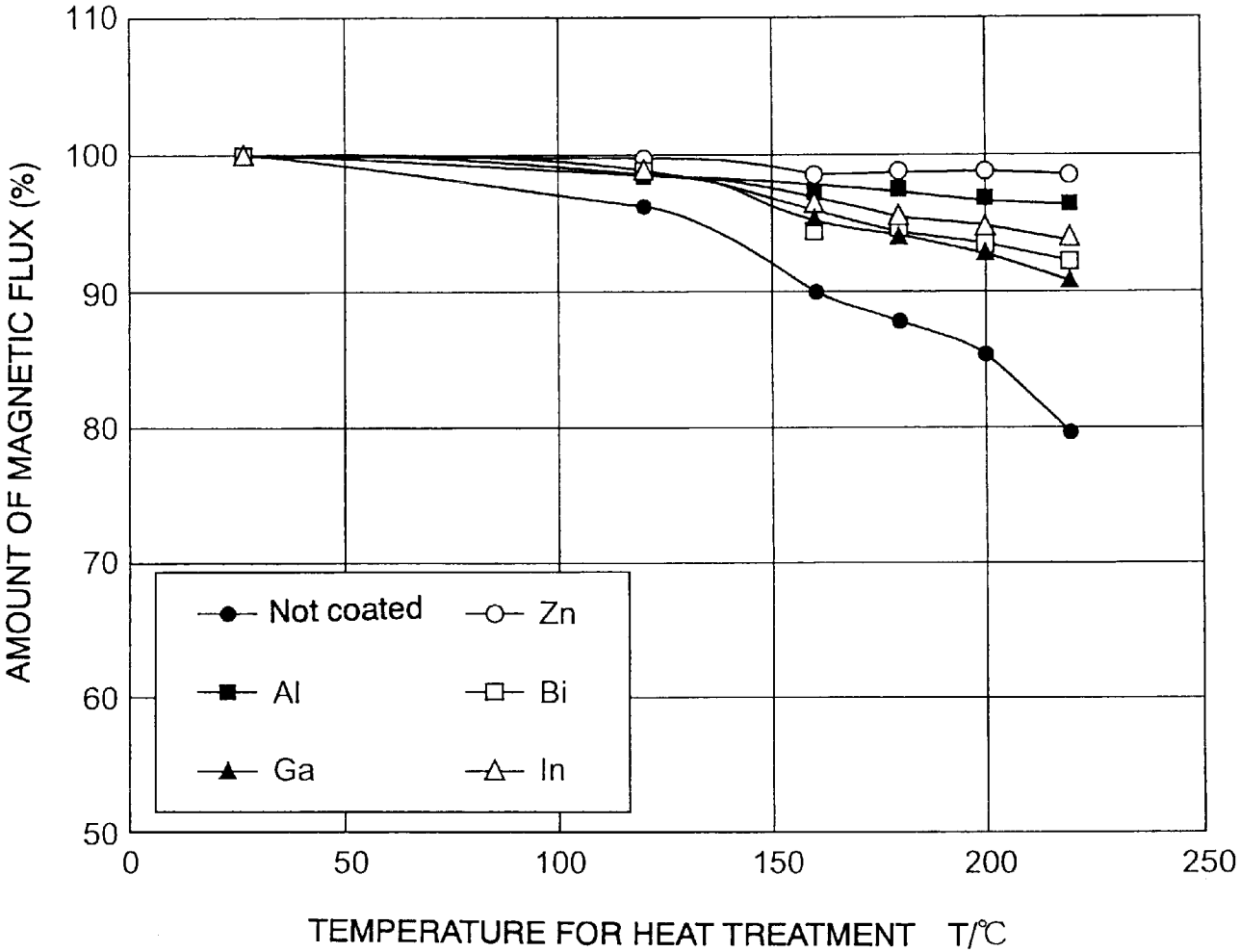
FIG. 1 graphically shows measured data of relationships between magnetic flux amounts and temperature of heat treatment in magnetic cores each comprising a magnetically biasing bond magnet including magnetic powder uncovered with any covering metal and covered with different covering metals in a first embodiment of this invention.

Now, description will proceed to, as embodiments of this invention, manufacturing of concrete magnetic cores with reference to the drawing and measured data or the like thereof will be illustrated.

(First Embodiment)

Now, illustration will be made about examples measured and compared variations of magnetic flux in a case of heat treating, in a thermostatic chamber, a ferrite core of $Sm_2Co_{17}$ series having a magnetic gap in which a bond magnet is inserted, wherein the bond magnet comprises $Sm_2Co_{17}$ magnetic powder consisting of an aggregation of magnetic particles each of which has a surface covered with various types of metals.

In order to make the bond magnet, the $Sm_2Co_{17}$ magnetic powder (having an average particle size of 2.3 μm) is mixed with each metal of zinc, aluminum, bismuth, gallium, indium, magnesium, lead, antimony, and tin by 5 vol % and then subjected to heat treatment for two hours in an atmosphere of argon. Each temperature of the heat treatment for each metal is shown in Table 1.

TABLE 1

| Element | Heat treatment temperature (° C.) |
|---|---|
| Zn | 475 |
| Al | 725 |
| Bi | 325 |
| Ga | 100 |
| In | 225 |
| Mg | 700 |
| Pb | 375 |
| Sb | 700 |
| Sn | 300 |

Thereafter, each magnetic powder is mixed with, as binder resin, 12-nylon resin having an amount corresponding to 40 vol % in a total volume, is heat kneaded, and is formed using a die in no magnetic field to obtain a bond magnet having a shape of 10.6 mm×7.0 mm×1.5 mm. The bond magnet is magnetized in a magnetic path direction of a magnetic core under pulse magnetic field of about 10 T.

Figure 2:
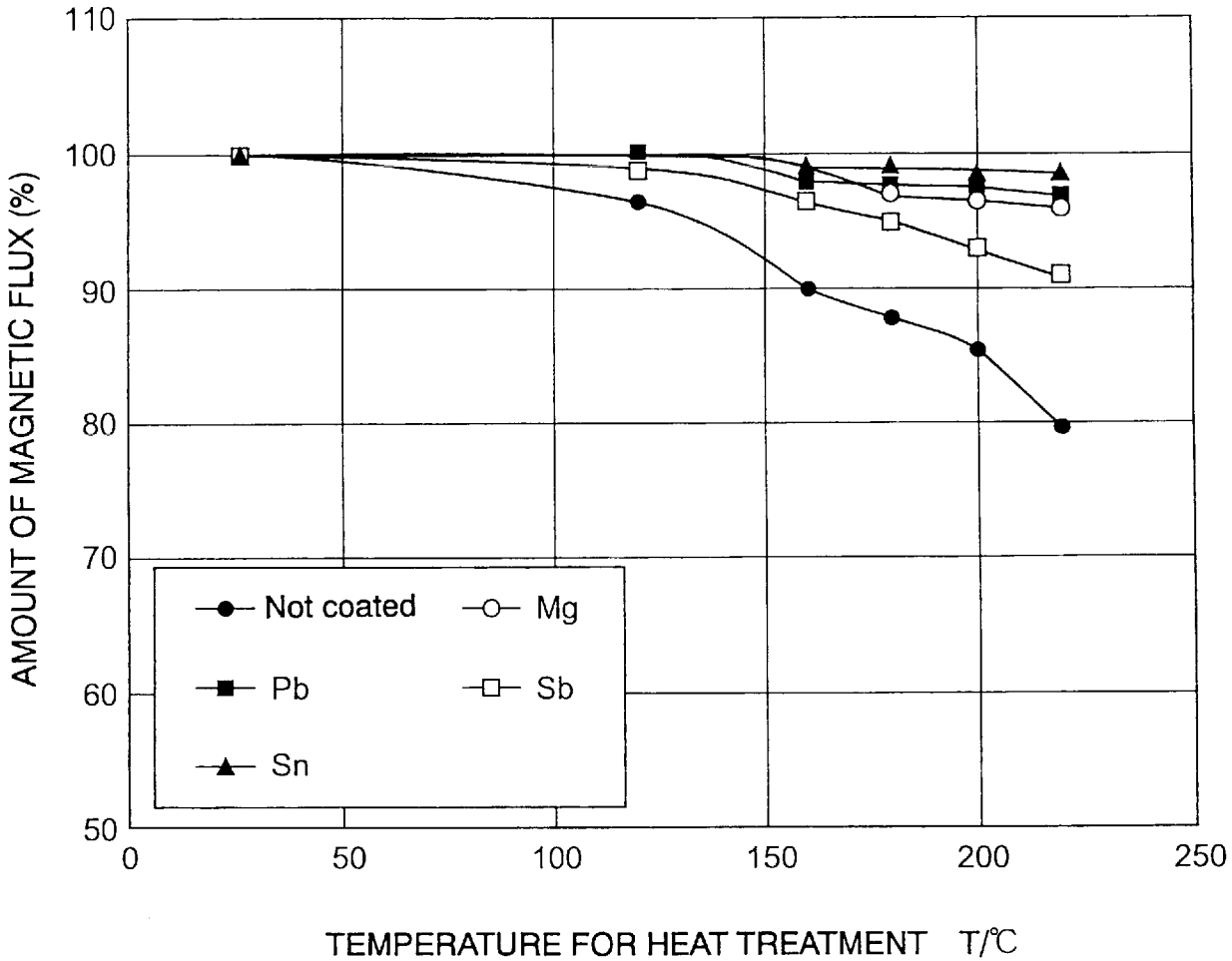
FIG. 2 graphically shows measured data of relationships between magnetic flux amounts and temperature of heat treatment in magnetic cores each comprising a magnetically biasing bond magnet including magnetic powder uncovered with any covering metal and covered with further different covering metals in a first embodiment of this invention.

Each bond magnet is disposed in the magnetic gap of the magnetic core. Each resultant magnetic core is heat treated in a thermostatic chamber for about 30 minutes from 120° C. up to 220° C. in units of 20° C., is taken out of the thermostatic chamber for each heat treatment, and magnetic flux thereof is measured. These results are shown in FIGS. 1 and 2.

According to the results, the magnet comprising the magnetic powder consisting of an aggregation of magnetic particles surfaced with no coating is demagnetized up to 80% at 220° C. in comparison with the magnet prior to heat treatment. On the contrary, it has been understood that the magnet comprising the magnet power consisting of an aggregation of magnetic particles surfaced with any coating of the above-mentioned metals is demagnetized up to 99–91% at heat treatment of 220° C., is very little in degradation, and has a stable characteristic. This is thought that oxidation of the magnet is suppressed by coating each particle's surface of the magnetic powder with the oxidation-resistant metal and then reduction of the magnetic flux is restricted.

(Second Embodiment)

Now, measurement and comparison are made about characteristic of Sm—Fe—N bond magnet where Zn having different amounts is covered to a surface of each particle in a magnetic powder and magnetic flux of the magnet before and after heat treatment is measured and variation thereof is calculated. In addition, examples where comparison for DC superposition characteristics and core-loss characteristic are carried out are illustrated in a case where each of those magnets is disposed in a magnet gap of a magnetic path of a ferrite Making of the bond magnet is carried out as follows. Metal covering is performed by mixing the magnetic powder of Sm—Fe—N (which has an average particle size of about 3 μm) with 3 vol % Zn and by subjecting to heat treatment in an atmosphere of Ar at temperature of 425° C. for two hours. Thereafter, each magnetic powder is mixed with, as binder resin, 12-nylon resin having an amount corresponding to 40 vol % in a total volume, is heat kneaded, and is subjected to heat press in no magnetic field to obtain a bond magnet having a shape of 10.6 mm×7.0 mm×1.5 mm. The bond magnet is magnetized in a magnetic path direction of a magnetic core under pulse magnetic field of about 10 T. Those bond magnet have characteristics as shown in Table 2.

TABLE 2

| Amount of Zn | Coercive Force Hc | Residual Magnetic Flux Density Br |
|---|---|---|
| no coating | 9 kOe | 3300 G |
| 0.1 vol % | 10.5 kOe | 3300 G |
| 1.0 vol % | 11.5 kOe | 3270 G |
| 3.0 vol % | 12 kOe | 3200 G |
| 5.0 vol % | 12 kOe | 3120 G |
| 10 vol % | 12 kOe | 2940 G |
| 15 vol % | 12 kOe | 2700 G |

It is understood that each bond magnet covered with Zn has an increased coercive force by 1.5–3 Oe in comparison with the bond magnet uncovered with any metal. This may be supposed that covering the particle's surface of the Sm—Fe—N magnetic powder results in difficulty of occurrence of inverse domain and in increasing the coercive force. In addition, the residual magnetic flux density decreases when the amount of Zn increases. It may be understood that a ratio of the magnetic powder decreases when the amount of Zn which is non-magnetism increases.

Those bond magnets are heat treated in a fireplace of an atmosphere of air at temperature of 220° C. for sixty minutes, are taken out of the fireplace, and measurement of magnetic flux, DC superposition characteristics, and core-loss characteristic are carried out.

The magnetic flux is measured for each magnet by using a digital flux meter of TDF-5 made by TOEl. In addition, re-pulse magnetization is carried out after end of the heat treatment at temperature of 220° C., a recovered amount of the magnetic flux is calculated as thermal demagnetization caused by thermal fluctuation and an unrecovered decreased amount is calculated as demagnetization caused by oxidation.

Those measured results are shown in Table 3 with flux amount of no heat treatment represented at 100%.

TABLE 3

| Variation of Magnetic Flux with Heat Treatment (%) | | | | | |
|---|---|---|---|---|---|
| Amount of Zn | No treatment | After heat-treatment | After re-magnet-ization | Thermal demagnetizing factor | Oxida-tion |
| No coat | 100 | 51 | 77 | 26 | 23 |
| 0.1 vol % | 100 | 74 | 94 | 20 | 6 |
| 1.0 vol % | 100 | 79 | 97 | 18 | 3 |
| 3.0 vol % | 100 | 81 | 98 | 17 | 2 |
| 5.0 vol % | 100 | 82 | 99 | 17 | 1 |
| 10 vol % | 100 | 82 | 99 | 17 | 1 |
| 15 vol % | 100 | 81 | 98 | 17 | 2 |

According to the results, the core inserted with the magnet comprising the magnetic powder consisting of an aggregation of magnetic particles surfaced with no coating is oxidized by 23% at temperature of 220° C. In comparison with this, it is seen that the core inserted with the magnet the magnetic powder consisting of an aggregation of magnetic particles surfaced with a coating of zinc is oxidized by about 1–6% caused by heat treatment, is very small in degradation, and has a stable characteristic. It may be seemed that oxidation is suppressed by coating the particle's surface of the magnetic powder with the oxidation-resistant metal and reduction of the magnetic flux is suppressed.

In addition, with respect to the thermal demagnetization, the magnet comprising the magnetic powder consisting of an aggregation of magnetic particles surfaced with a coating of zinc has a lower value in comparison with the magnet comprising the magnetic powder consisting of an aggregation of magnetic particles surfaced with no coating. It may be thought that the coercive force of the Sm—Fe—N magnet increases by coating the particle's surface of the magnetic powder with zinc.

Figure 3A:
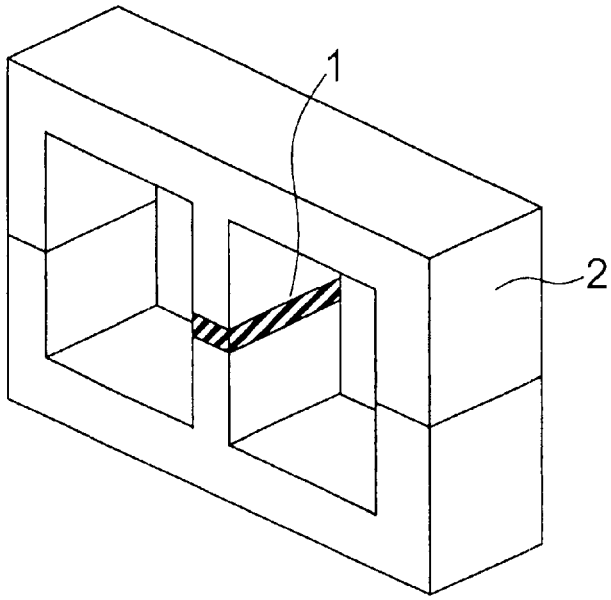
FIG. 3A is a perspective view of a magnetic core according to the first embodiment of this invention.
Figure 3B:
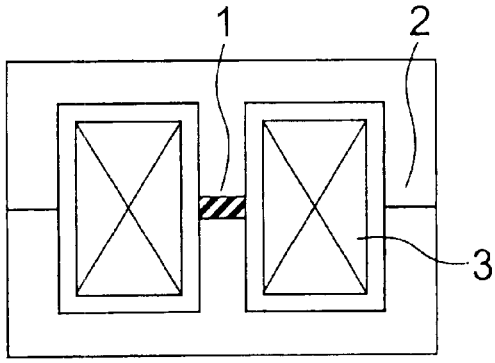
FIG. 3B is a cross sectional view of a choke coil comprising the magnetic core illustrated in FIG. 3A.

The DC superposition characteristic is measured for each core inserted with the magnet by the use of an LCR meter of 4284A made by Hewlett Packard under conditions of AC magnetic field frequency of 100 kHz and of magnetic field of 0–200 Oe due to DC superposition. A ferrite core used in experiment is an EE core which is made of a ferrite material of Mn—Zn series, has a magnetic path of 7.5 cm, and has an effective cross-sectional area of 0.74 $cm^2$. The EE core has a central magnetic leg with a gap of 1.5 mm. In the gap portion is disposed a bond magnet formed so as to have a cross section equal to that of the central magnetic leg of the ferrite core and to have a height of 1.5 mm. These shapes are illustrated in FIGS. 3A and 3B. In these figures, a reference numeral of 1 represents the bond magnet, a reference numeral of 2 represents the core, and a reference numeral of 3 represents a coil. In addition, a DC superposition current is flowed in the coil 3 so that a direction of a magnetic field caused by DC superposition faces in the opposite direction to a direction of magnetization in the bond magnet 1 disposed in the magnetic gap of the core 2.

Figure 4:
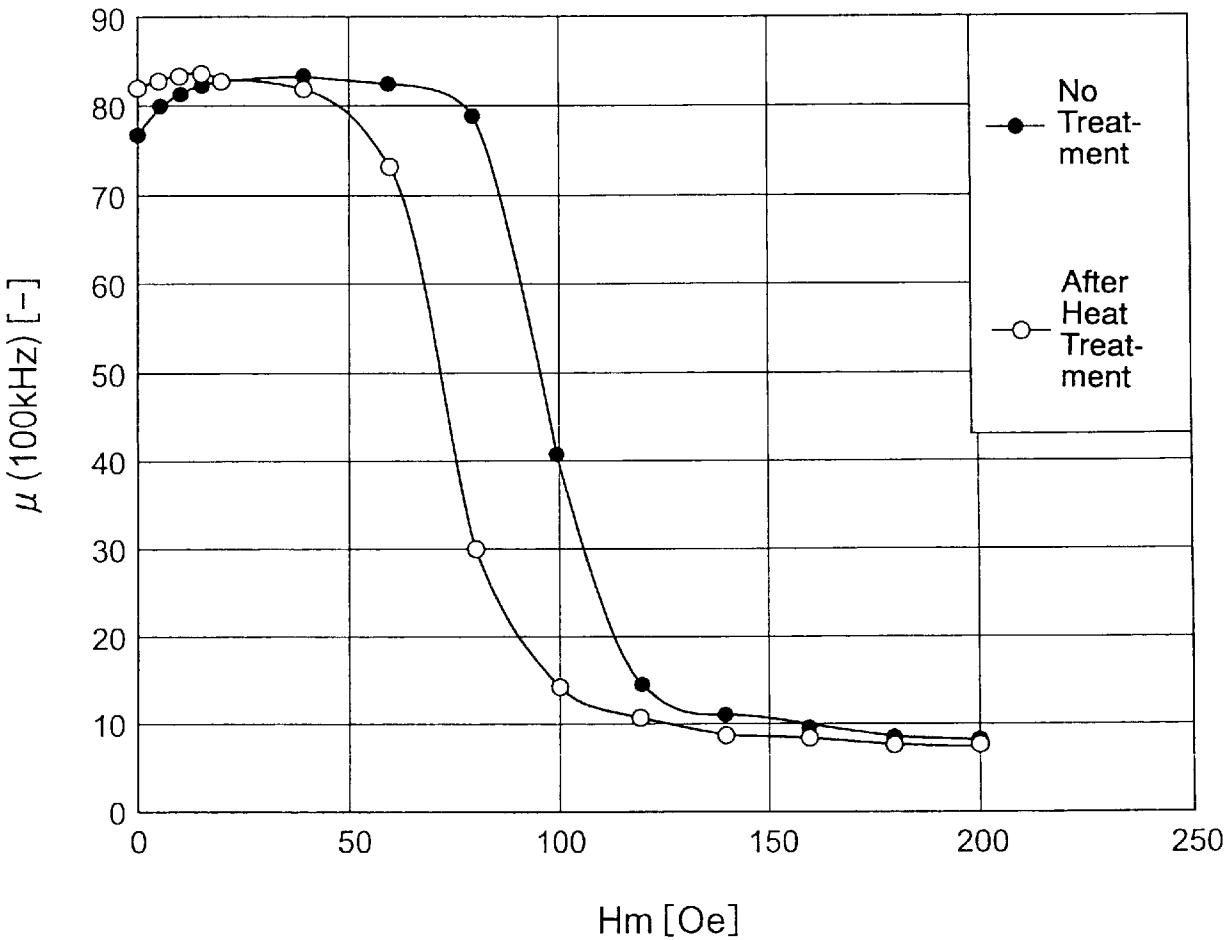
FIG. 4 graphically shows measured data of a DC superposition characteristic in a second embodiment of this invention in a case where the magnetic powder is uncovered with any covering metal.
Figure 5:
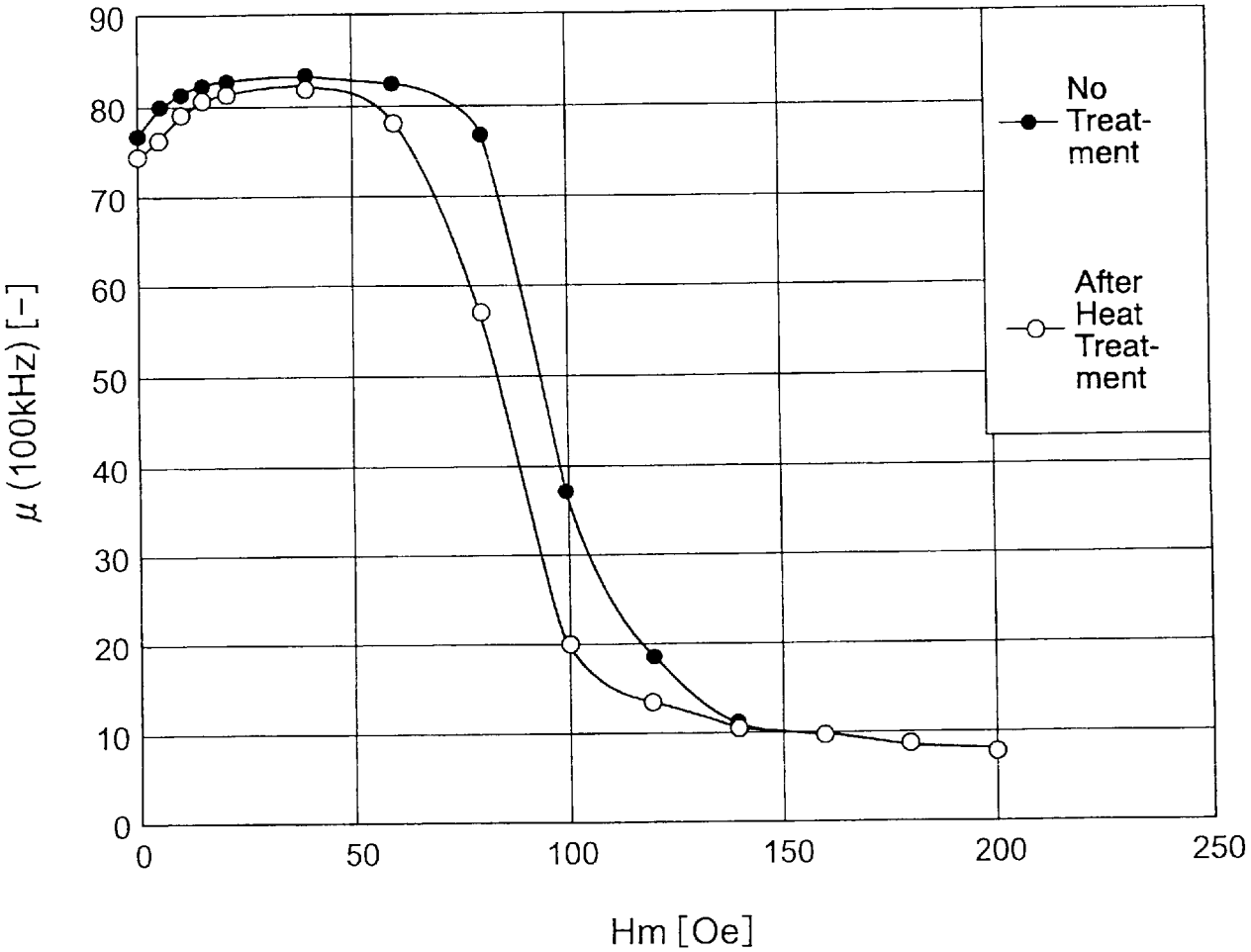
FIG. 5 graphically shows measured data of a DC superposition characteristic in the second embodiment of this invention in a case where the magnetic powder is covered with 0.1 vol % zinc.
Figure 6:
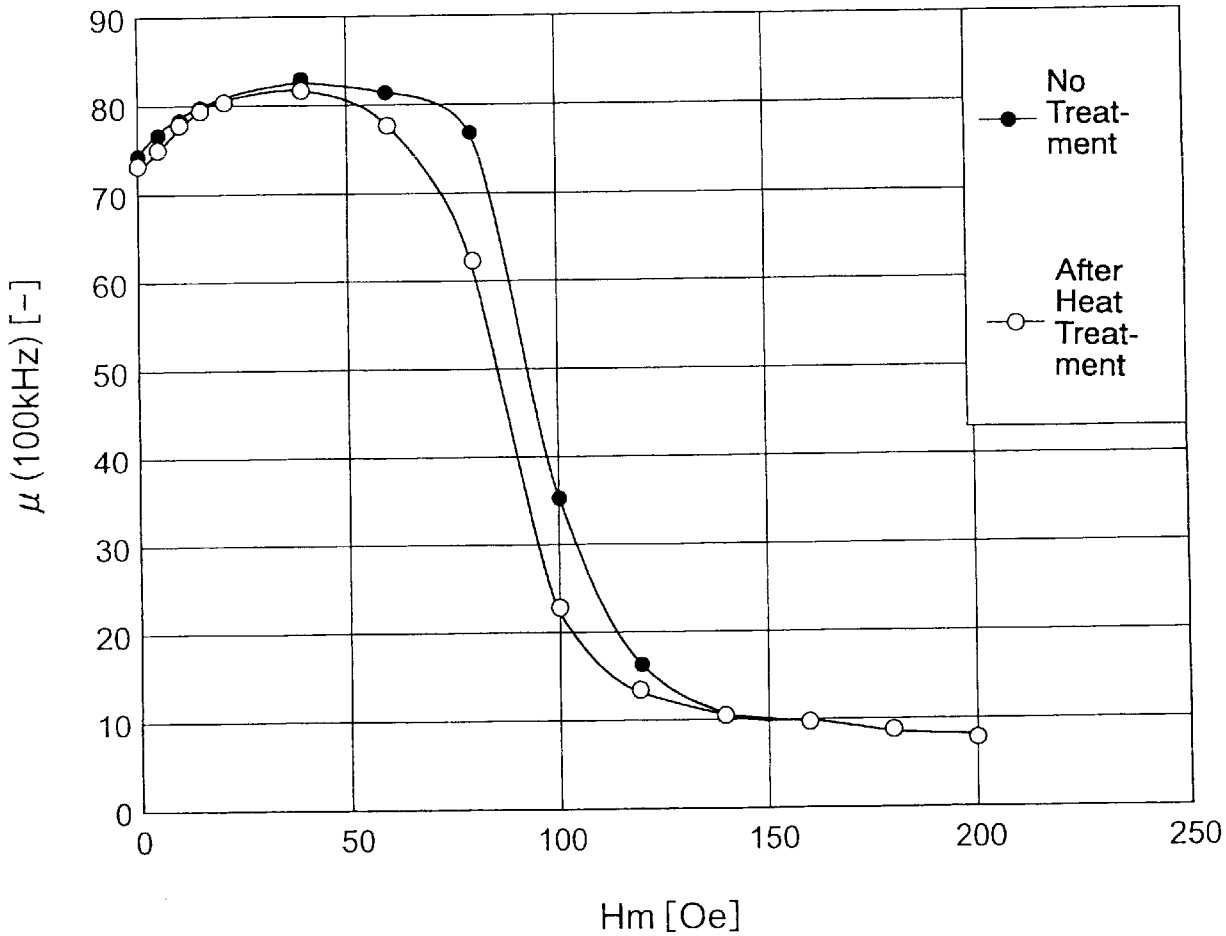
FIG. 6 graphically shows measured data of a DC superposition characteristic in the second embodiment of this invention in a case where the magnetic powder is covered with 1.0 vol % zinc.
Figure 7:
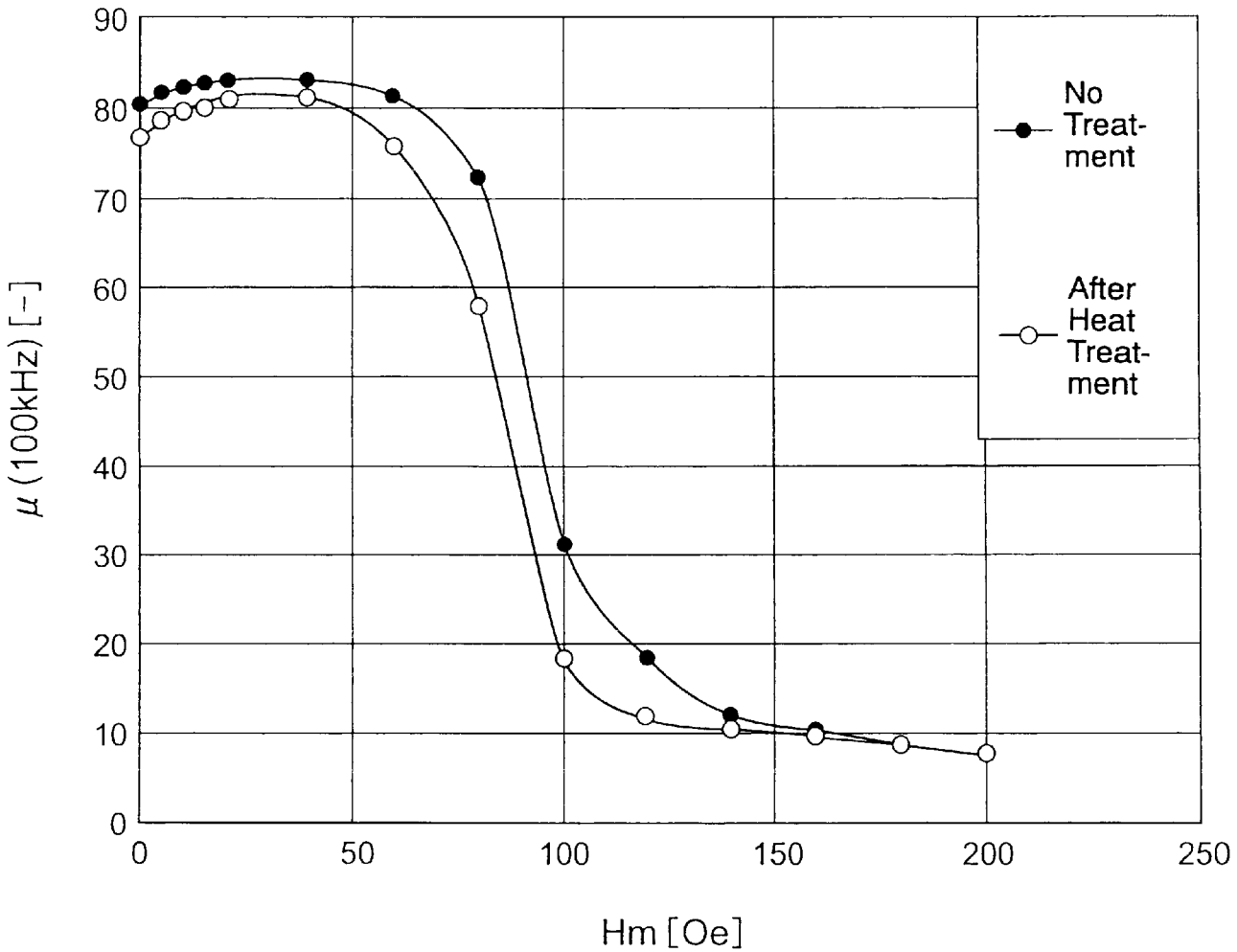
FIG. 7 graphically shows measured data of a DC superposition characteristic in the second embodiment of this invention in a case where the magnetic powder is covered with 3.0 vol % zinc.
Figure 8:
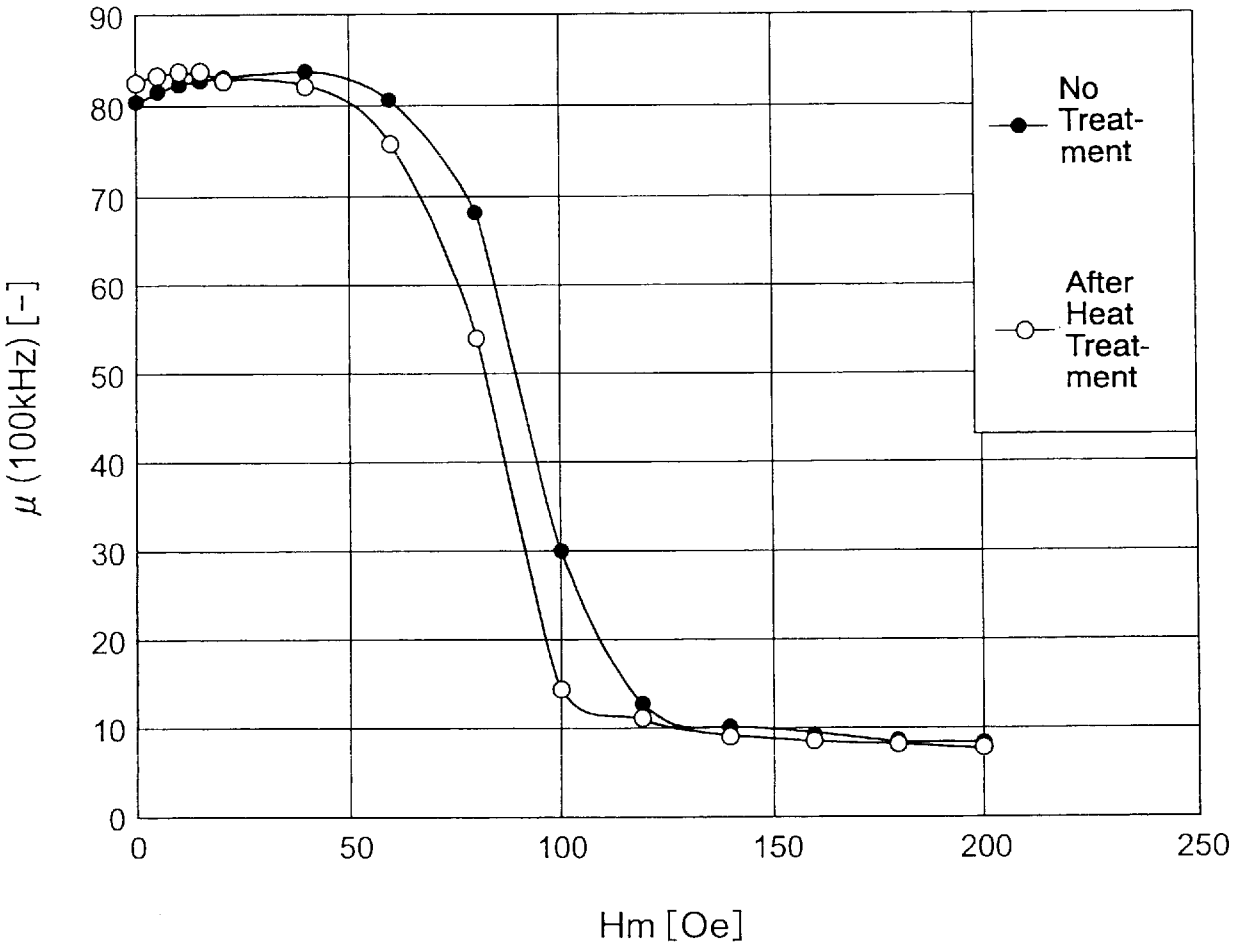
FIG. 8 graphically shows measured data of a DC superposition characteristic in the second embodiment of this invention in a case where the magnetic powder is covered with 5.0 vol % zinc.
Figure 9:
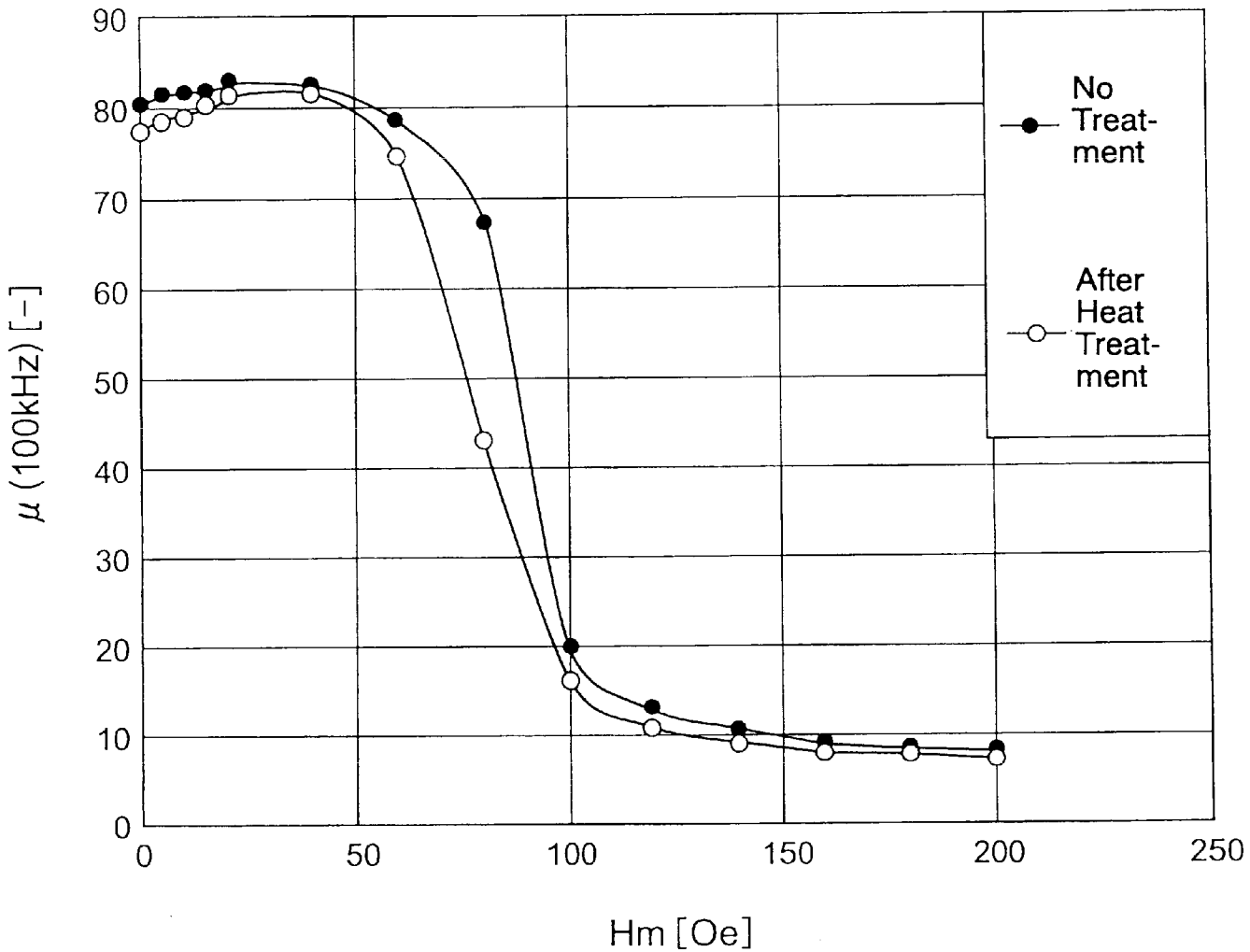
FIG. 9 graphically shows measured data of a DC superposition characteristic in the second embodiment of this invention in a case where the magnetic powder is covered with 10 vol % zinc.

The measured results are illustrated in FIGS. 4 through 10. FIG. 4 shows the DC superposition characteristics in a case where the bond magnet comprising the magnetic powder consisting of an aggregation of magnetic particles surfaced with no coating is used. FIGS. 5–10 show the DC superposition characteristics in cases where bond magnets comprising the magnetic powder consisting of an aggregation of magnetic particles surfaced with coatings of zinc content of 0.1 vol %, 1.0 vol %, 3.0 vol %, 5.0 vol %, 10 vol %, and 15 vol % are used, respectively.

Figure 10:
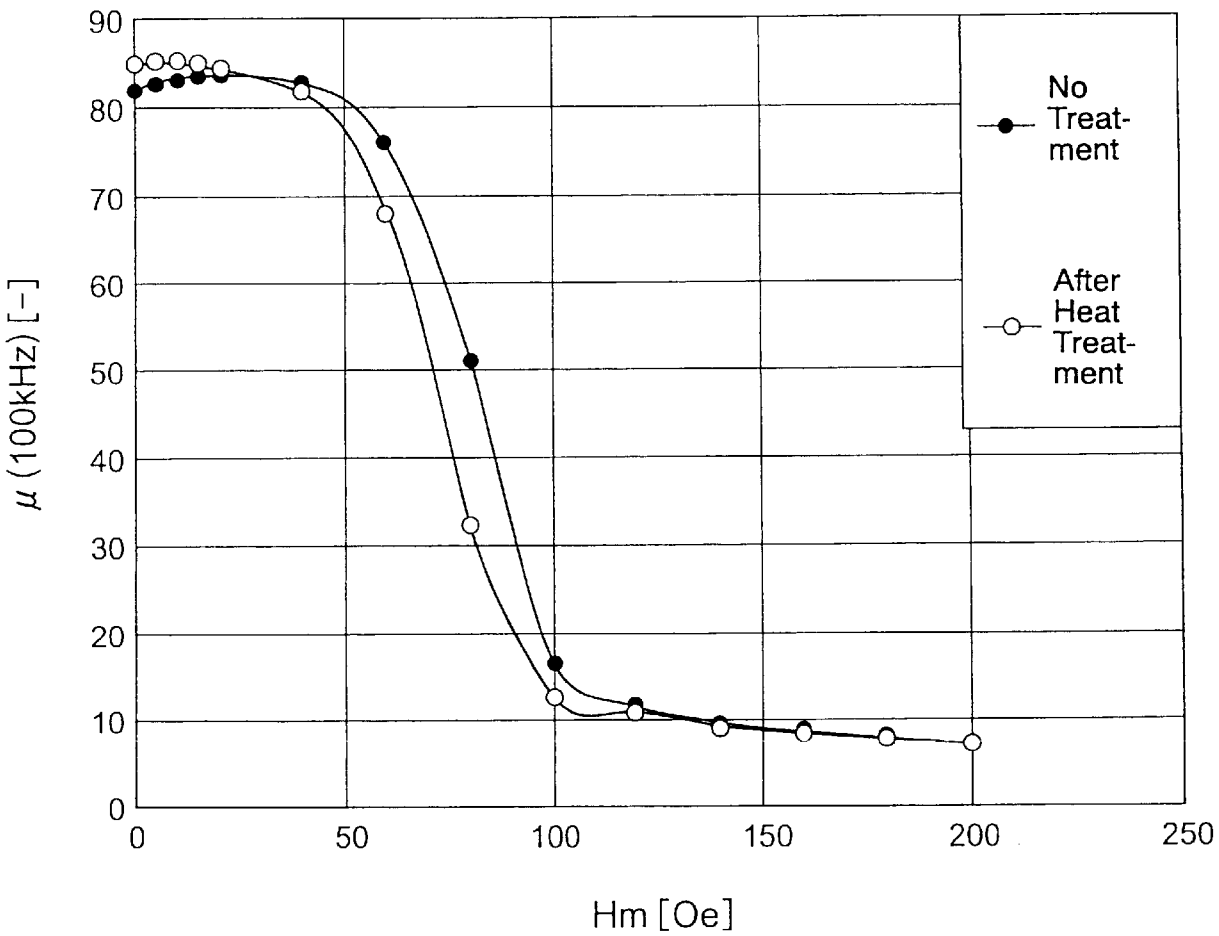
FIG. 10 graphically shows measured data of a DC superposition characteristic in the second embodiment of this invention in a case where the magnetic powder is covered with 15 vol % zinc.

As is apparent from FIG. 4, when the magnetic particles of the magnetic powder are surfaced with no coating, the magnetic permeability was shifted to the lower magnetic field side with increase of a heat treatment time interval to significantly degrade the characteristics. In comparison with this, as shown in FIGS. 5–9, when the magnetic particles of the magnetic powder are surfaced with a coating of zinc, it is understood that a degradation rate in heat treatment is always very small. This may be supposed that oxidation of the magnetic powder is suppressed due to a coating of zinc. In addition, as shown in FIG. 10, when the magnetic powder is mixed with 15 wt % zinc, it is understood that magnetic permeability of the magnetic core does not extend to a higher magnetic field side and magnitude of a biasing magnetic field due to the magnet is very small in comparison with others. It may be thought that a rate of the magnetic powder decreases caused by increase of an amount of zinc or magnitude of the magnetization decreases because the magnetic powder and zinc reacts to each other.

Now, in the magnetic cores inserted with those magnet in respective magnetic gaps thereof, core-loss characteristic at a frequency of 200 kHz and in a magnetic flux density of 0.1 T were measured by use of an AC B-H curve tracer of SY-8232 made by Iwasaki Tsushinki K.K. The ferrite core used in experiment was an EE core which is made of a ferrite material of Mn—Zn series and which has a magnetic path of 7.5 cm and has an effective cross-sectional area of 0.74 $cm^2$. The EE core comprises a central magnetic leg with a magnetic gap of 1.5 mm. A bond magnet formed so as to have a cross section equal to that of central magnetic leg of the ferrite core and to have a height of 1.5 mm was magnetized in a direction of the magnetic path under a pulse magnetic field of about 10 T and was inserted in a gap portion of the ferrite core. These results are shown in Table 4.

TABLE 4

Variation of core-loss ($kW/m^3$) and specific resistance ($\Omega \cdot cm$) with heat treatment

| Amount of Zn | No treatment | After heat treatment | Increment | Specific resistance (before heat treatment) |
|---|---|---|---|---|
| No coat | 360 | 585 | 225 | 2.08 |
| 0.1 vol % | 365 | 445 | 80 | 2.02 |
| 1.0 vol % | 395 | 395 | 0 | 1.72 |
| 3.0 vol % | 410 | 380 | −30 | 1.43 |
| 5.0 vol % | 440 | 420 | −20 | 1.25 |
| 10 vol % | 490 | 460 | −30 | 1.00 |
| 15 vol % | 755 | 740 | −15 | 0.23 |

When the magnetic particles of the magnetic powder are surfaced with no coating, the core-loss increases by 200 $kW/m^3$ or more caused by heat treatment. In contrast with this, when the magnetic particles of the magnetic powder are surfaced with a coating with the above-mentioned metal, increment of the core-loss after heat treatment was 80 $kW/m^3$ in a case of a coating of 0.1 vol % Zn and was less than zero in a case of coatings of 1.0 vol % or more Zn. When Zn content of the magnetic powder is 3.0 vol % or more, it seems that the core-loss shows a tendency to decrease to the contrary. In addition, when the magnetic powder is mixed with zinc by 15 vol %, the core-loss itself was nearly 750 $kW/m^3$ and had a very large value although the increment of the core-loss does not occur after heat treatment. It may be thought that eddy-current loss increases because the specific resistance of the bond magnet in a case of mixing the magnetic powder with zinc by 15 wt % is 0.23 $\Omega \cdot cm$ and is very smaller than other compositions.

In addition, it seems that the reason the core-loss decreased caused by heat treatment is that insulation among the powder increases caused by oxidation of zinc and the eddy-current loss decreases.

For the above-mentioned reasons it is understood that the ferrite core has a very excellent characteristic when the amount of Zn used as a coating lies in a range of 0.1–10 vol % in a total volume of the magnetic powder. In addition, similar results may be obtained in a case of using, as a coating, one metal or alloy thereof listed in Table 1 of the first embodiment in lieu of Zn because each of these metal or alloy has a specific resistance which is hardly ever different in comparison with that of Zn.

(Third Embodiment)

Now, illustration will be made about examples measured and compared DC superposition characteristics and core-loss characteristic of a ferrite core of Mn—Zn series having a magnetic gap in which a Sm—Co bond magnet is inserted, wherein the bond magnet comprises magnetic powder consisting of an aggregation of magnetic particles surfaced with coatings of various types of metals.

In order to make the bond magnet, the Sm—Co magnetic powder (having an average particle size of 3 μm) was mixed with each metal of zinc, aluminum, bismuth, gallium, indium, magnesium, lead, antimony, and tin by 5 vol % and then was subjected to heat treatment for two hours in an atmosphere of argon. Each temperature of the heat treatment for each metal is shown in the above-mentioned Table 1 described in the above-mentioned first embodiment.

Thereafter, each magnetic powder was mixed with, as binder resin, epoxy resin having an amount corresponding to 40 vol % in a total volume, and was thereafter formed using a die in no magnetic field. The ferrite core used in experiment was an EE core which is made of a ferrite material of Mn—Zn series and which has a magnetic path of 7.5 cm and has an effective cross-sectional area of 0.74 $cm^2$. The EE core comprises a central magnetic leg with a magnetic gap of 1.5 mm. A bond magnet formed so as to have a cross section equal to that of the central magnetic leg of the ferrite core and to have a height of 1.5 mm was inserted in a gap portion of the ferrite core and a coil was wound around the core. Those shapes are shown in FIGS. 3A and 3B.

Each bond magnet was disposed in the magnetic gap of the magnetic core. Each resultant magnetic core was heat treated in a thermostatic chamber having a temperature of 270° C., was taken out of the thermostatic chamber for after a lapse of thirty minutes, and the DC superposition characteristics and the core-loss characteristic thereof were measured.

The DC superposition characteristic was measured for each core inserted with the magnet by the use of an LCR meter of 4284A made by Hewlett Packard under conditions of AC magnetic field frequency of 100 kHz and of magnetic field of 0–200 Oe due to DC superposition. In addition, a DC superposition current was flowed in the coil 3 so that a direction of a magnetic field caused by DC superposition faces in the opposite direction to a direction of magnetization in the bond magnet 1 disposed in the magnetic gap of the core 2.

Figure 11:
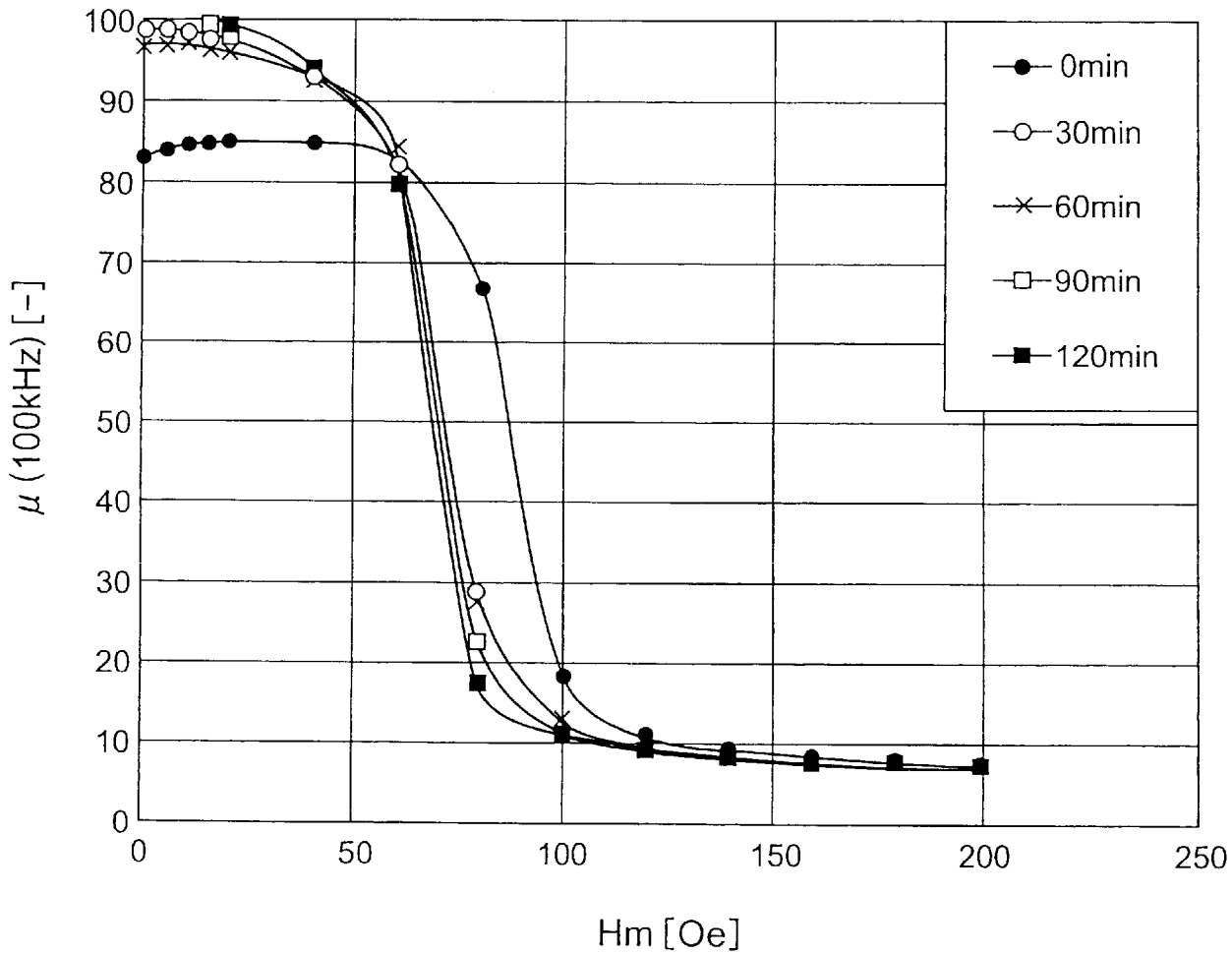
FIG. 11 graphically shows measured data of a DC superposition characteristic in a third embodiment of this invention in a case where the magnetic powder is uncovered with any covering metal.
Figure 12:
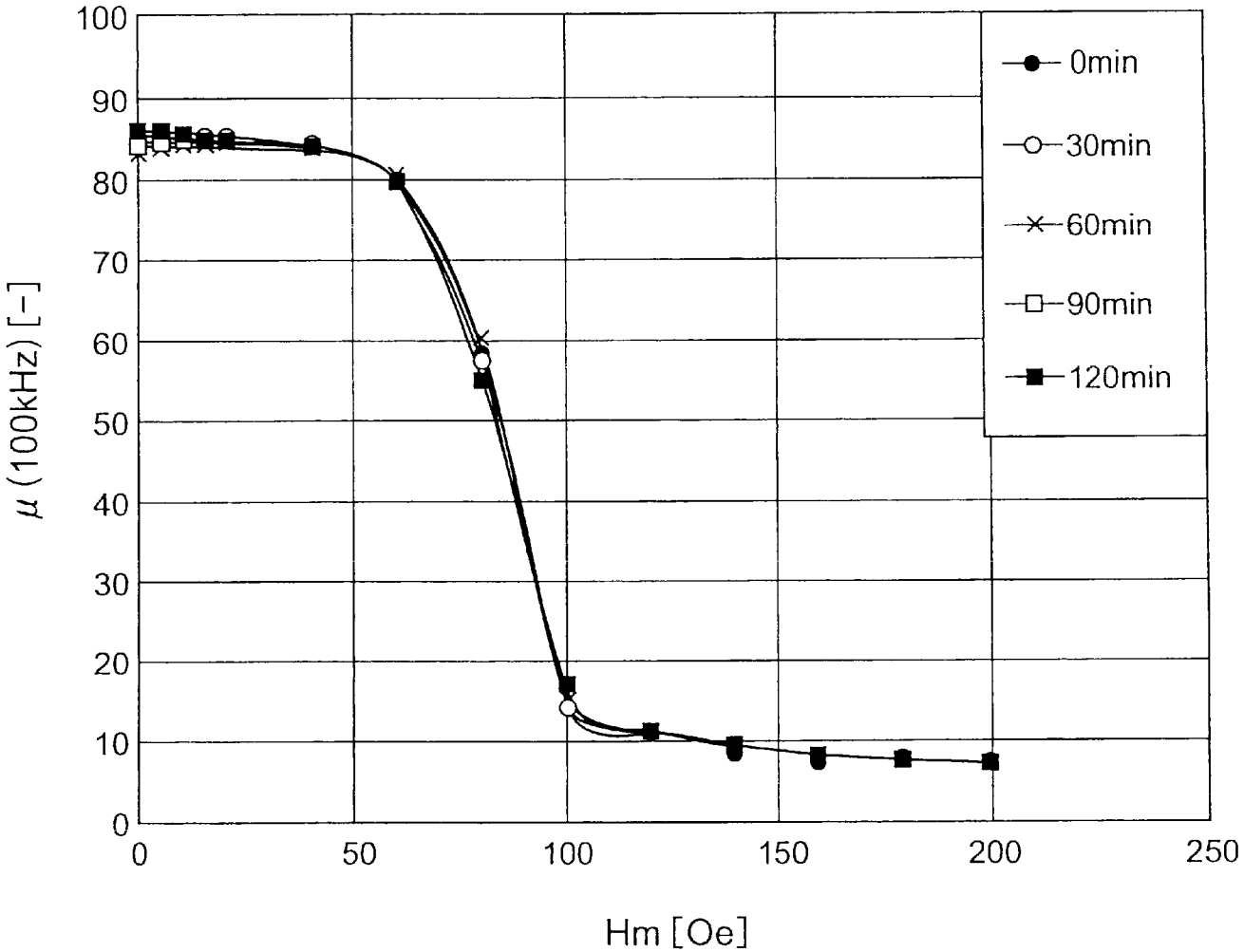
FIG. 12 graphically shows measured data of a DC superposition characteristic in the third embodiment of this invention in a case where the magnetic powder is covered with zinc.
Figure 13:
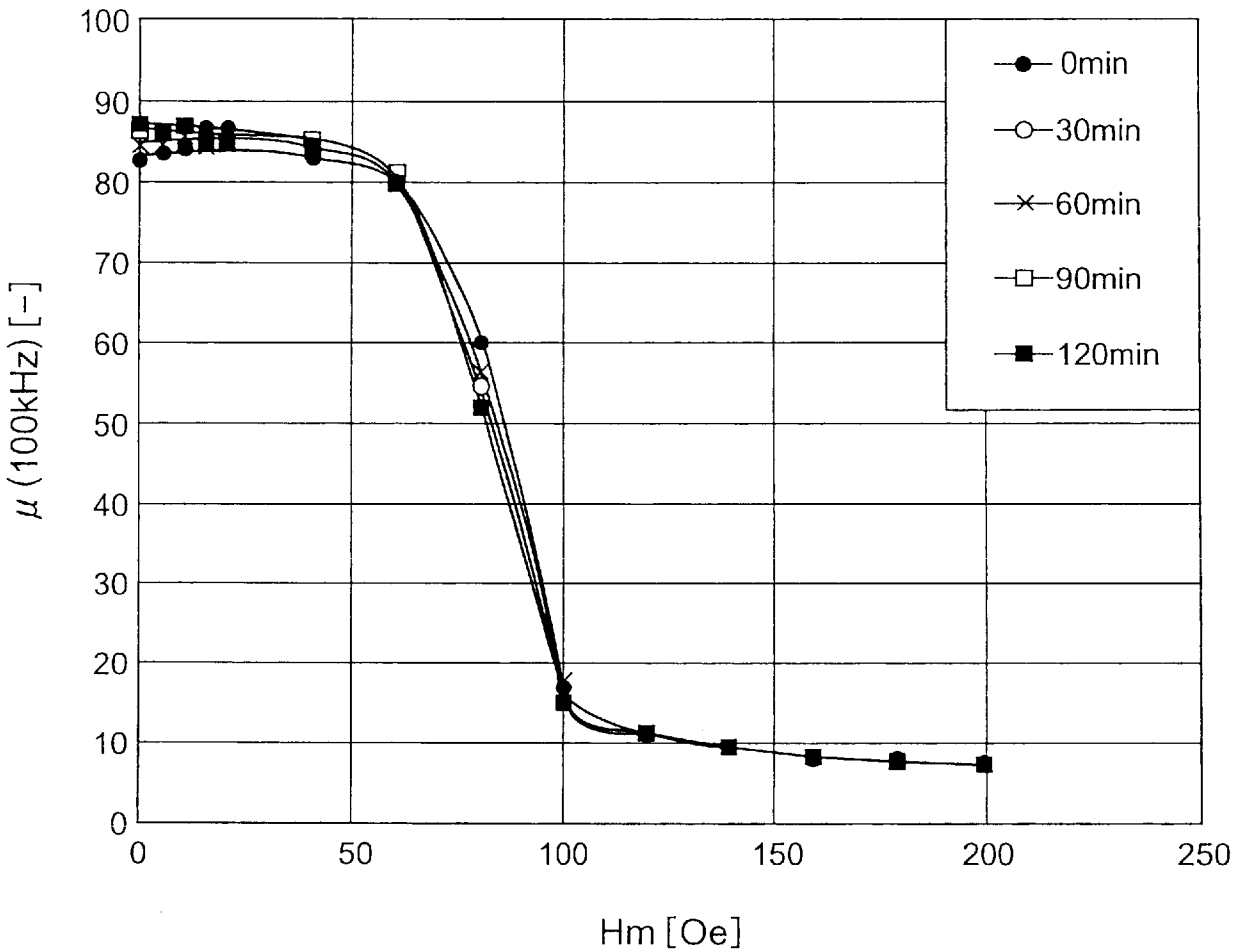
FIG. 13 graphically shows measured data of a DC superposition characteristic in the third embodiment of this invention in a case where the magnetic powder is covered with aluminum.
Figure 14:
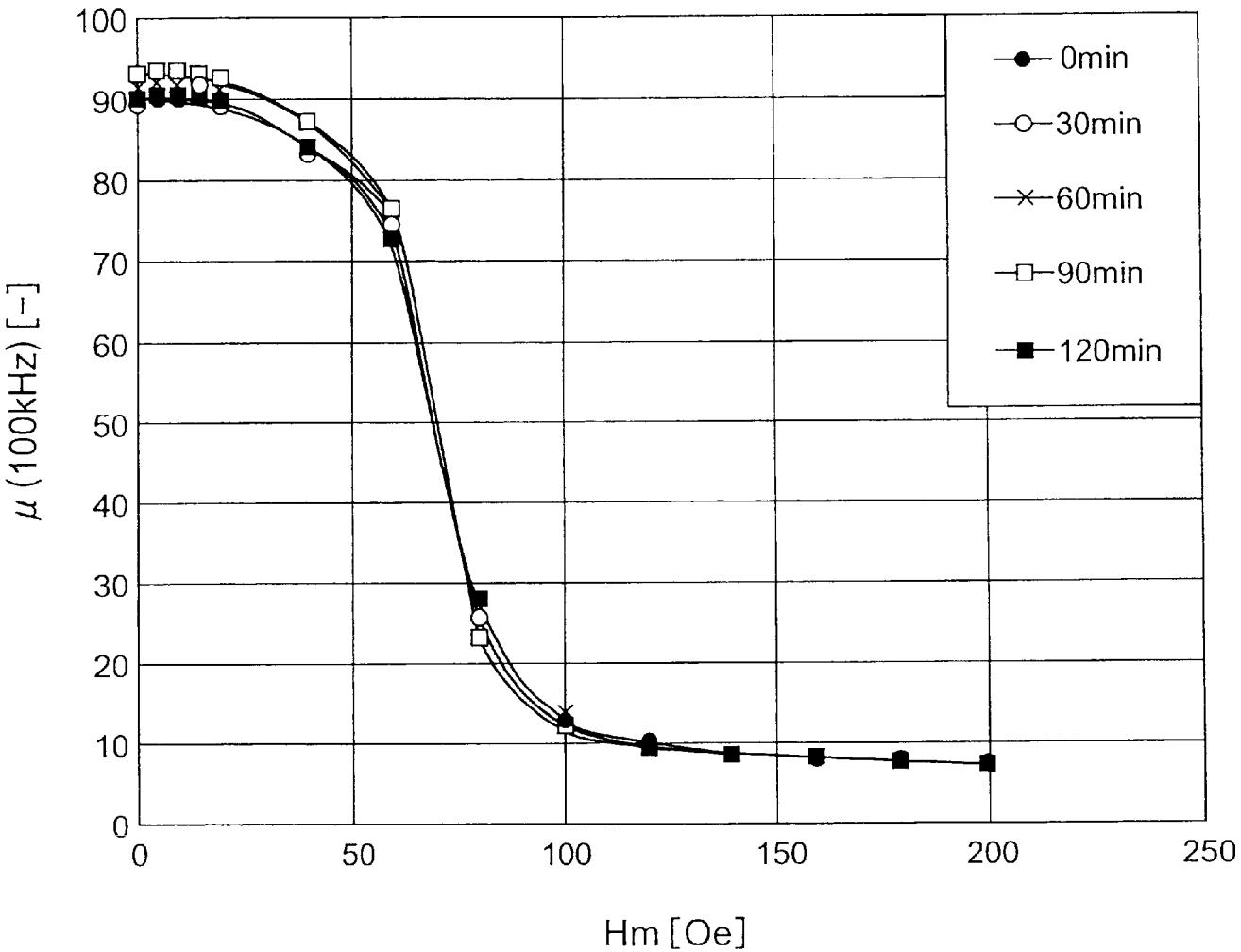
FIG. 14 graphically shows measured data of a DC superposition characteristic in the third embodiment of this invention in a case where the magnetic powder is covered with bismuth.
Figure 15:
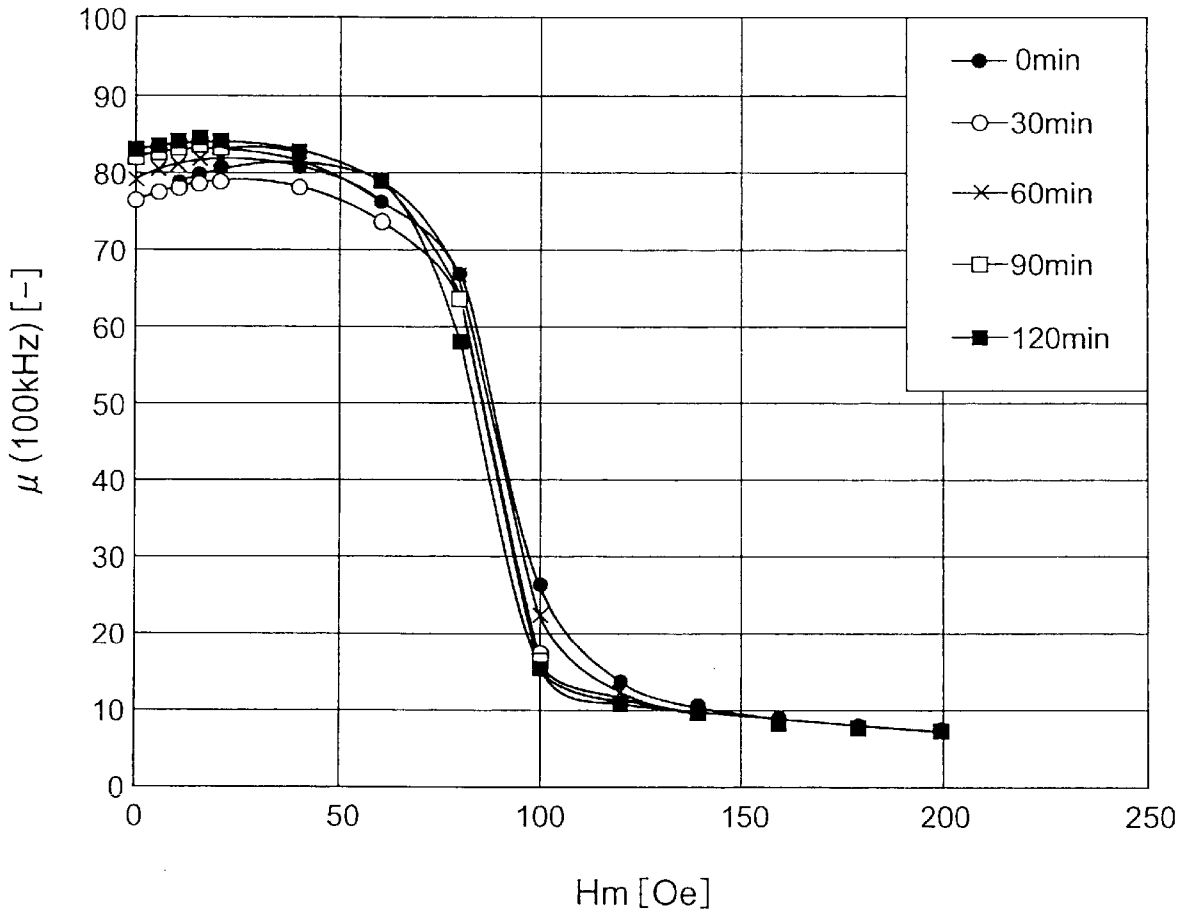
FIG. 15 graphically shows measured data of a DC superposition characteristic in the third embodiment of this invention in a case where the magnetic powder is covered with gallium.
Figure 16:
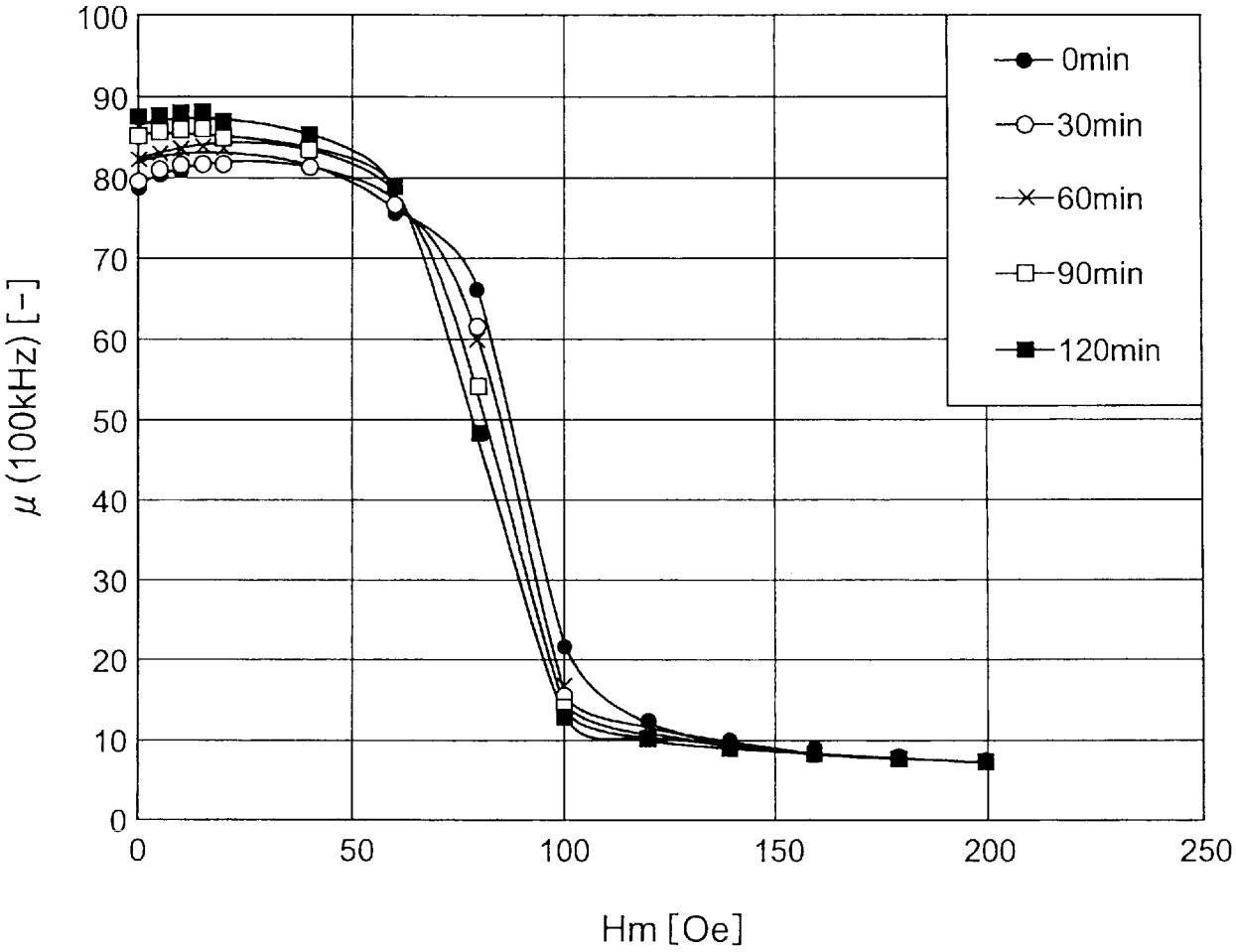
FIG. 16 graphically shows measured data of a DC superposition characteristic in the third embodiment of this invention in a case where the magnetic powder is covered with indium.
Figure 17:
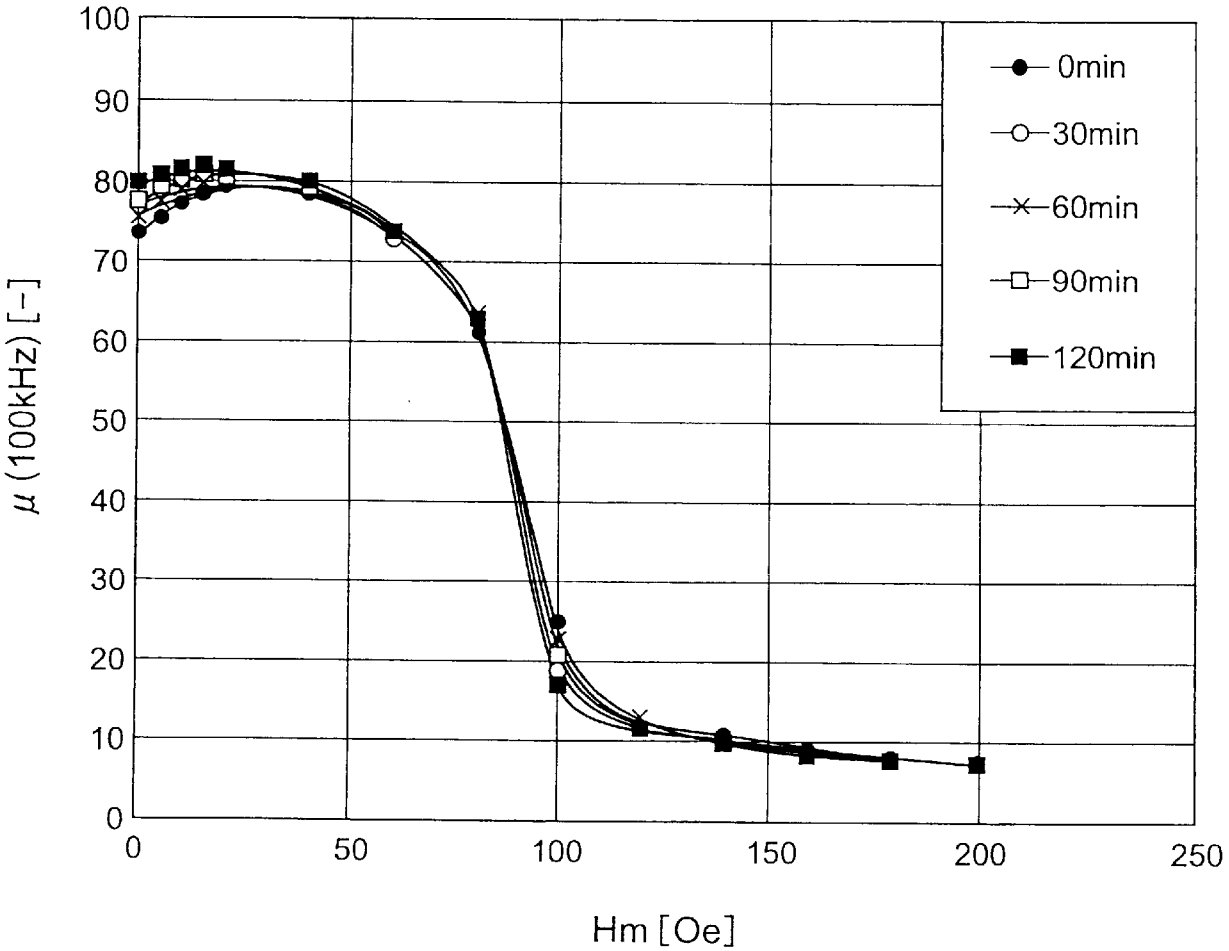
FIG. 17 graphically shows measured data of a DC superposition characteristic in the third embodiment of this invention in a case where the magnetic powder is covered with magnesium.
Figure 18:
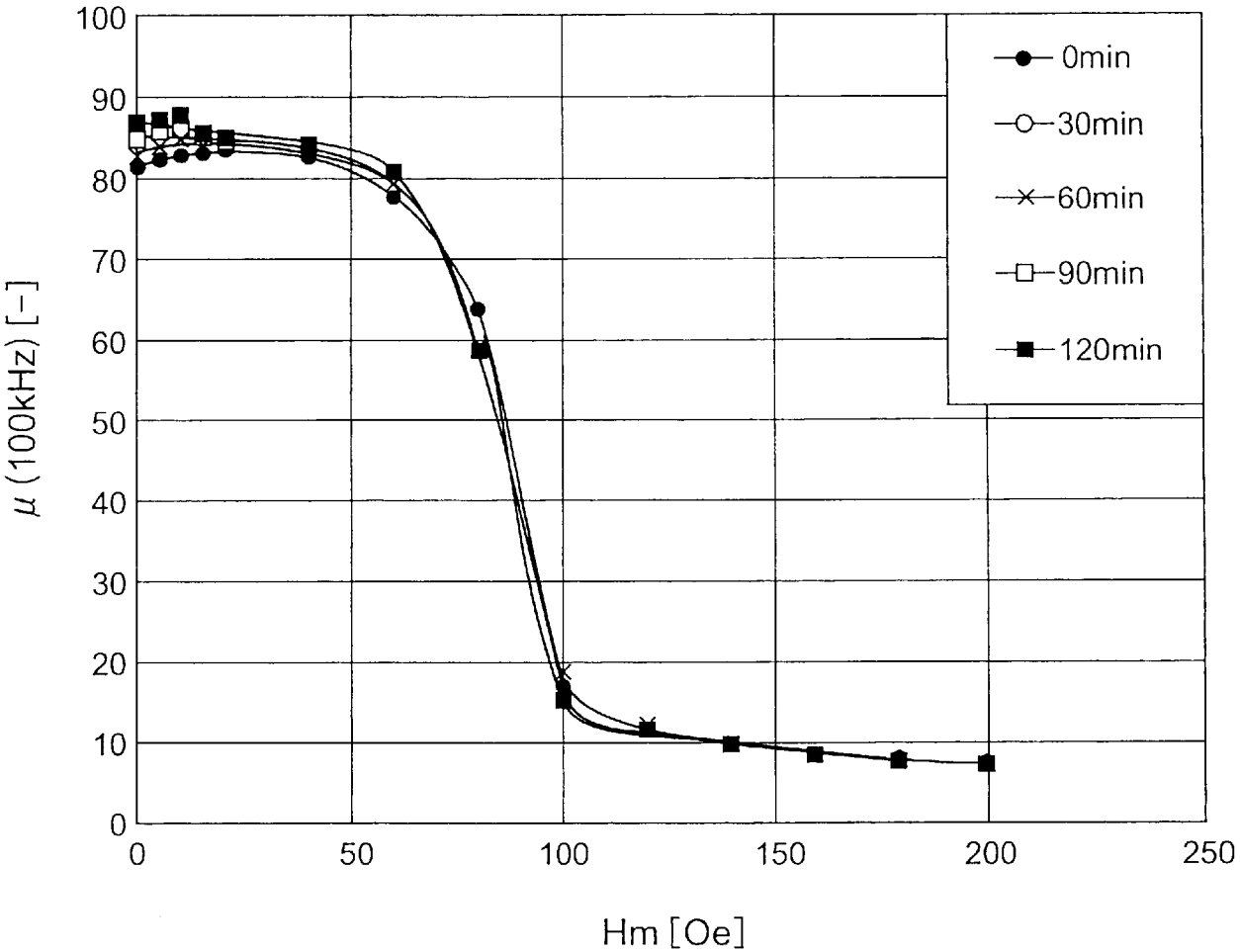
FIG. 18 graphically shows measured data of a DC superposition characteristic in the third embodiment of this invention in a case where the magnetic powder is covered with lead.
Figure 19:
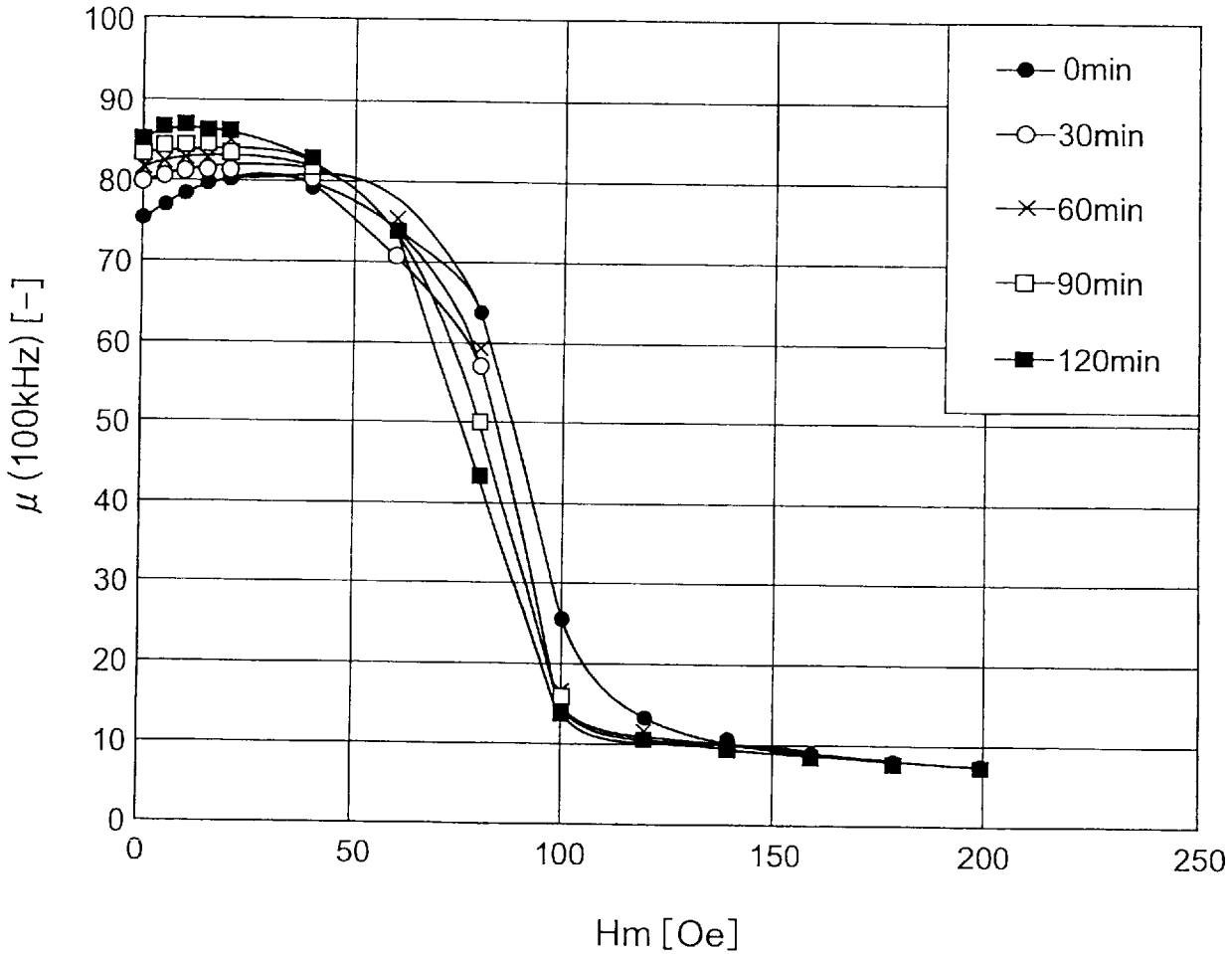
FIG. 19 graphically shows measured data of a DC superposition characteristic in the third embodiment of this invention in a case where the magnetic powder is covered with antimony.
Figure 20:
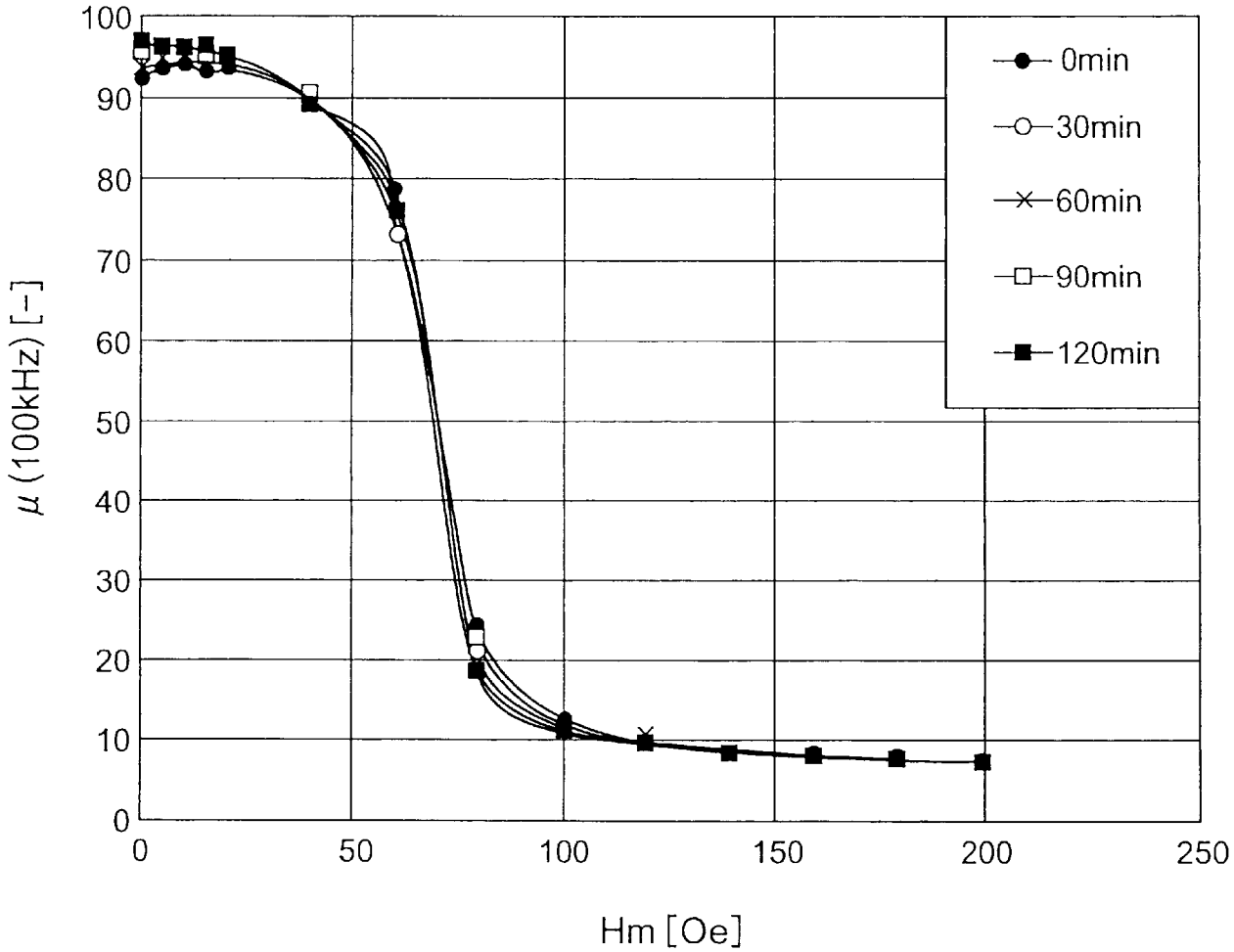
FIG. 20 graphically shows measured data of a DC superposition characteristic in the third embodiment of this invention in a case where the magnetic powder is covered with tin.

The measured results are illustrated in FIGS. 11 through 20. FIG. 11 shows the DC superposition characteristics in a case where the bond magnet comprising the magnetic powder consisting of an aggregation of magnetic particles surfaced with no coating is used. FIGS. 12–20 show the DC superposition characteristics in cases where bond magnets comprising the magnet powder consisting of an aggregation of magnetic particles surfaced with coatings of zinc, aluminum, bismuth, gallium, indium, magnesium, lead, antimony, and tin, respectively.

It is seen, in comparison with the magnetic core inserted with the bond magnet comprising the magnetic powder consisting of an aggregation of magnetic particles surfaced with no coating, that the magnetic core inserted with the bond magnet comprising the magnetic powder consisting of an aggregation of magnetic particles surfaced with a coating of any one of the above-mentioned metal has a little degradation of the DC superposition characteristics although a time interval of the heat treatment increases and has a stable characteristic. This may be thought that oxidation is suppressed by coating the particle's surface of the magnetic powder with oxidation-resistant metal and decrease in the biasing magnetic field is suppressed.

Now, in the magnetic cores inserted with those magnets, the core-loss characteristic at a frequency of 5 kHz and in a magnetic flux density of 0.1 T was measured by use of an AC B-H curve tracer of SY-8232 made by Iwasaki Tsushinki K.K. These results are shown in Table 5.

TABLE 5

Measured data of core-loss

| Time interval of heat treatment | 0 min | 30 min | 60 min | 90 min | 120 min |
|---|---|---|---|---|---|
| None | 180 | 250 | 360 | 450 | 600 |
| Zn | 220 | 200 | 215 | 215 | 220 |
| Al | 180 | 180 | 190 | 200 | 240 |
| Bi | 225 | 230 | 230 | 230 | 240 |
| Ga | 170 | 180 | 230 | 230 | 260 |
| In | 175 | 200 | 220 | 230 | 280 |
| Mg | 170 | 170 | 180 | 200 | 220 |
| Pb | 230 | 220 | 230 | 240 | 260 |
| Sb | 200 | 230 | 280 | 350 | 420 |
| Sn | 205 | 210 | 230 | 230 | 235 |

In the core inserted with the bond magnet comprising the magnetic powder consisting of an aggregation of magnetic particles surfaced with no coating, the core-loss in heat treatment for 120 minutes was three times or more as large as the core-loss with no heat treatment. In contrast with this, it is seen that, in the cores inserted with the respective bond magnets each comprising the magnetic powder consisting of an aggregation of magnetic particles surfaced with a coating of one of the above-mentioned metal, increment of the core-loss after heat treatment was on average 20–30% and the core had a very excellent characteristic.

(Fourth Embodiment)

Now, illustration will be made about examples measured and compared magnetic flux of a ferrite core of Mn—Zn series having a magnetic gap in which a Sm—Co bond magnet is inserted, wherein the Sm—Co bond magnet comprises magnetic powder consisting of an aggregation of magnetic particles surfaced with coatings with various types of metals.

In order to make the bond magnet, the Sm—Co magnetic powder (having an average particle size of 3 μm) was mixed with each of (3 vol % Zn+2 vol % Mg) and (3 vol % Mg+2 vol % Al) and then was subjected to heat treatment for two hours in an atmosphere of argon at temperature of 600° C., thereby carrying out metal coating. Thereafter, each magnetic powder was mixed with, as binder resin, epoxy resin having an amount corresponding to 45 vol % in a total weight, and was formed using a die in no magnetic field. Each bond magnet was heat treated in a furnace in an atmosphere of air at temperature of 270° C., was taken out of the furnace for each one hour up to heat treatment time interval of four hours in total and for each two hours thereafter, and magnetic flux thereof was measured.

The magnetic flux was measured for each magnet by using a digital flux meter of TDF-5 made by TOEl. When an amount of the magnetic flux before heat treatment is represented at 100%, Table 6 shows a rate of variations of the magnetic flux after each time interval of heat treatment.

TABLE 6

Variations in magnetic flux with heat treatment (%)

| Time interval of heat treatment (hour) | 0 | 1 | 2 | 3 | 4 | 6 | 8 | 10 |
|---|---|---|---|---|---|---|---|---|
| No coating | 100 | 72 | 61 | 53 | 45 | 36 | 30 | 26 |
| (3 vol % Zn + 2 vol % Mg) | 100 | 98 | 97 | 97 | 96 | 95 | 94 | 94 |

TABLE 6-continued

| Variations in magnetic flux with heat treatment (%) | | | | | | | | |
|---|---|---|---|---|---|---|---|---|
| Time interval of heat treatment (hour) | 0 | 1 | 2 | 3 | 4 | 6 | 8 | 10 |
| (3 vol % Mg + 2 vol % Al) | 100 | 98 | 98 | 97 | 96 | 96 | 95 | 94 |

The magnetic core inserted with the bond magnet comprising the magnetic powder consisting of an aggregation of magnetic particles surfaced with no coating was demagnetized by 70% or more after the heat treatment for ten hours. In comparison with this, it is understood that the magnetic core inserted with the bond magnet comprising the magnetic powder consisting of an aggregation of magnetic particles surfaced with coating of one of the above-mentioned metal was demagnetized by about 6% at the heat treatment for ten hours, was very small in degradation, and had a stable characteristic. It may be seemed that oxidation is suppressed by coating the particle's surface of the magnetic powder with the oxidation-resistant metal and reduction of the magnetic flux is restricted.

(Fifth Embodiment)

Now, illustration will be made about examples measured and compared DC superposition characteristics and core-loss characteristic of a ferrite core of Mn—Zn series having a magnetic gap in which a Sm—Co bond magnet is inserted, wherein the bond magnet comprises resin and magnetic powder, disposed in the resin, consisting of an aggregation of magnetic particles surfaced with a coating of zinc.

In order to make the bond magnet, the Sm—Co magnetic powder (having an average particle size of 3 m) was mixed with zinc by 0.1 vol %, 1.0 vol %, 3.0 vol %, 5.0 vol %, 10 vol %, and 15 vol %, respectively, and then was subjected to heat treatment for two hours in an atmosphere of argon. Thereafter, each magnetic powder was mixed with, as binder resin, epoxy resin having an amount corresponding to 40 vol % in a total volume, and was then formed using a die in no magnetic field. In the manner as the above-mentioned third embodiment, the ferrite core used in experiment was an EE core which has a magnetic path of 7.5 cm and has an effective cross-sectional area of 0.74 $cm^2$. The EE core comprises a central magnetic leg with a magnetic gap of 1.5 mm. A bond magnet formed so as to have a cross section equal to that of the central magnetic leg of the ferrite core and to have a height of 1.5 mm was magnetized in a direction of the magnetic path in pulse magnetic field of about 10 T and was inserted in a gap portion of the ferrite core, and a coil was wound around the core. Those shapes are shown in FIGS. 3A and 3B.

Each bond magnet was disposed in the magnetic gap of the magnetic core. Each resultant magnetic core was heat treated in a thermostatic chamber having a temperature of 270° C., was taken out of the thermostatic chamber after a lapse of thirty minutes, and the DC superposition characteristics and the core-loss characteristic thereof were measured. This process was repeated.

The DC superposition characteristic was measured for each core inserted with the magnet by the use of an LCR meter of 4284A made by Hewlett Packard under conditions of AC magnetic field frequency of 100 kHz and of magnetic field of 0–200 Oe due to DC superposition. In addition, a DC superposition current was flowed in the coil 3 so that a direction of a magnetic field caused by DC superposition faces in the opposite direction to a direction of magnetization in the bond magnet 1 disposed in the magnetic gap of the core 2.

Figure 21:
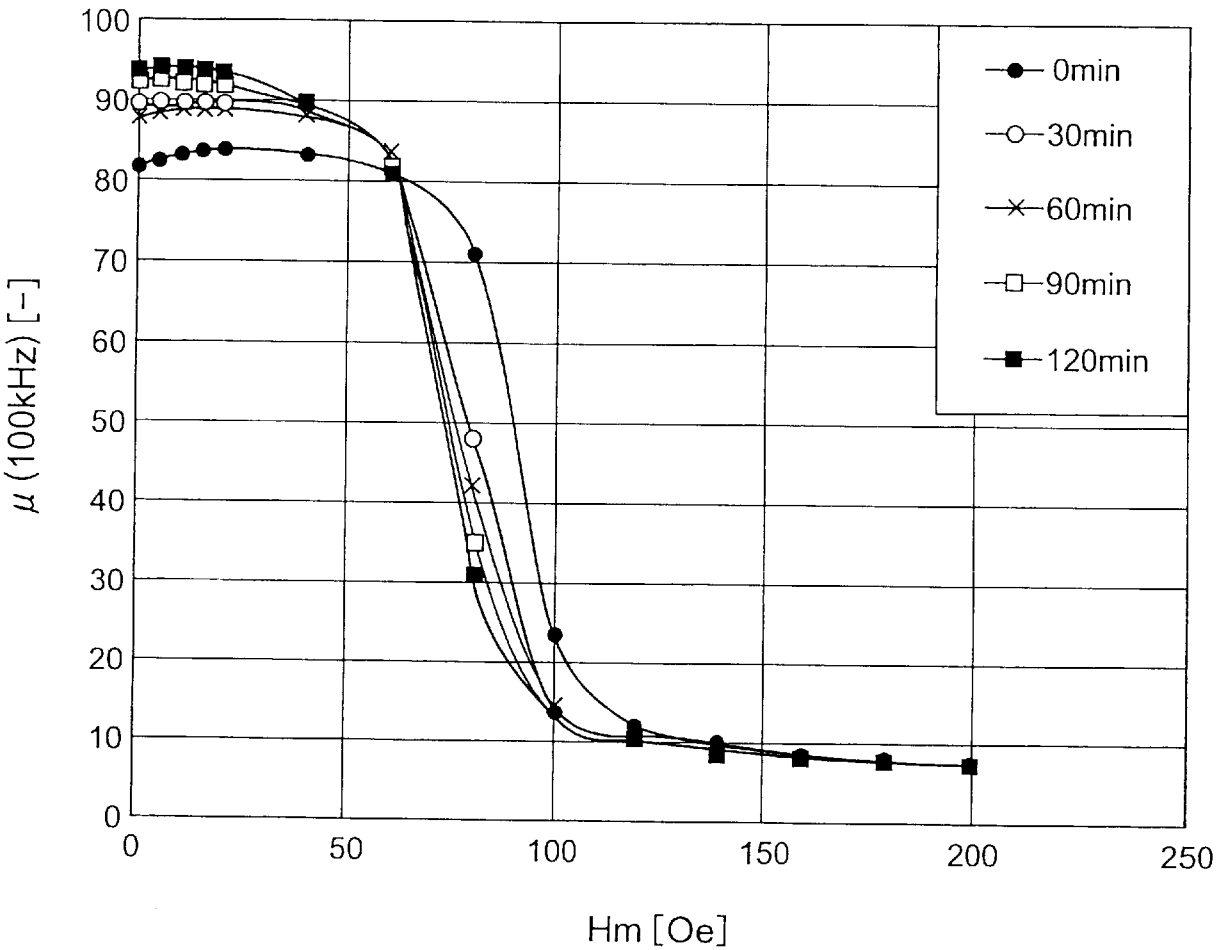
FIG. 21 graphically shows measured data of a DC superposition characteristic in a fifth embodiment of this invention in a case where the magnetic powder is uncovered with any covering metal.
Figure 22:
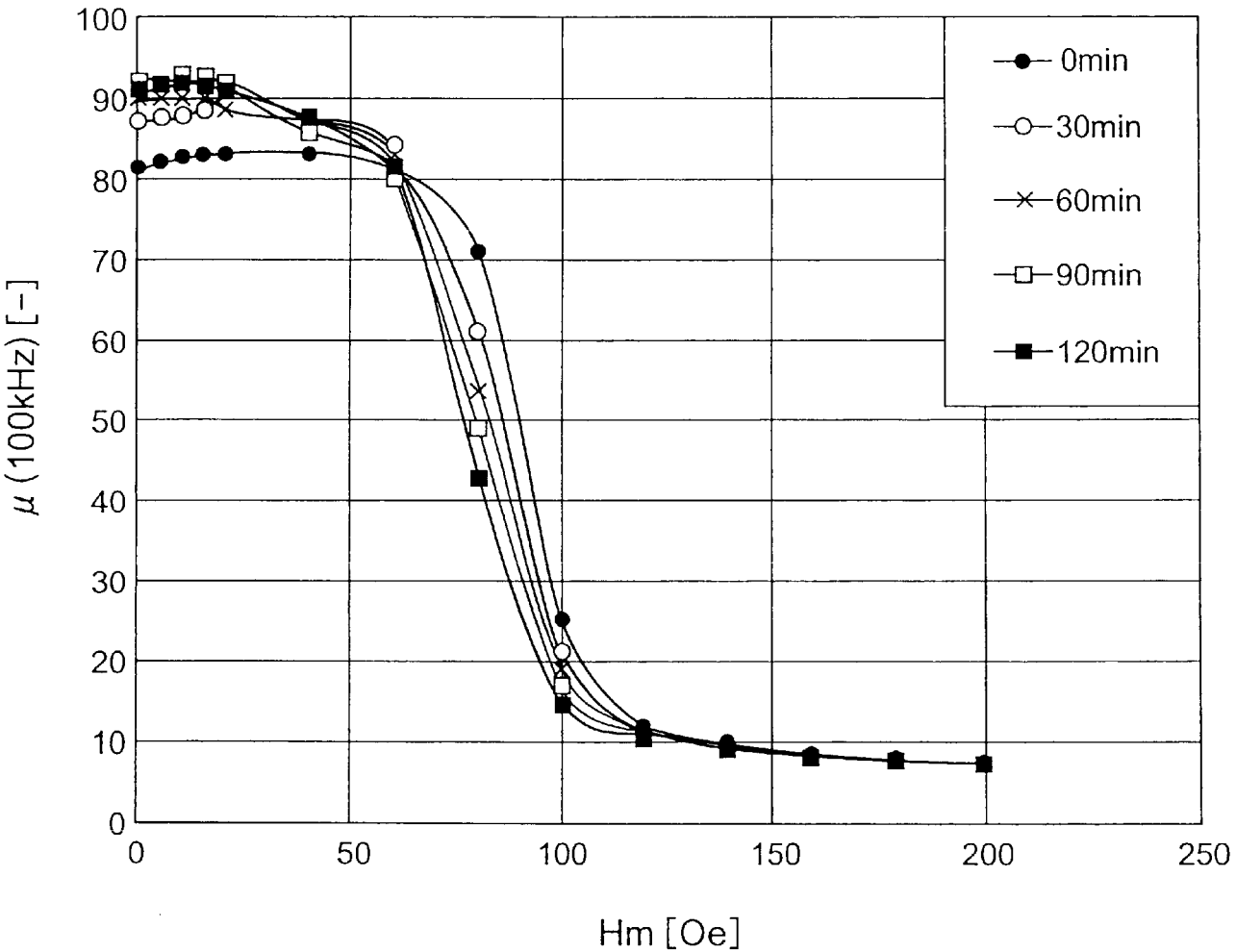
FIG. 22 graphically shows measured data of a DC superposition characteristic in the fifth embodiment of this invention in a case where the magnetic powder is covered with 0.1 vol % zinc.
Figure 23:
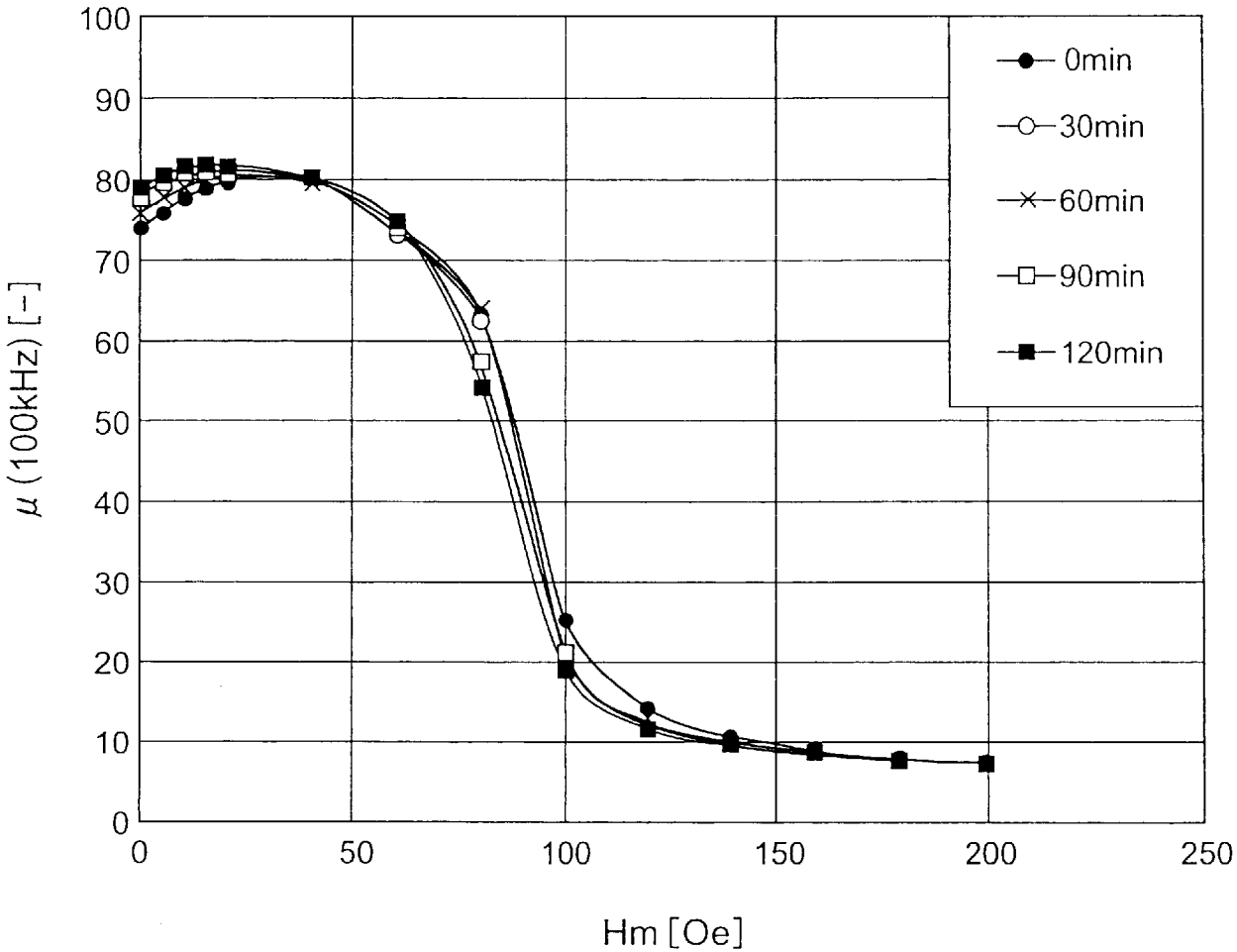
FIG. 23 graphically shows measured data of a DC superposition characteristic in the fifth embodiment of this invention in a case where the magnetic powder is covered with 1.0 vol % zinc.
Figure 24:
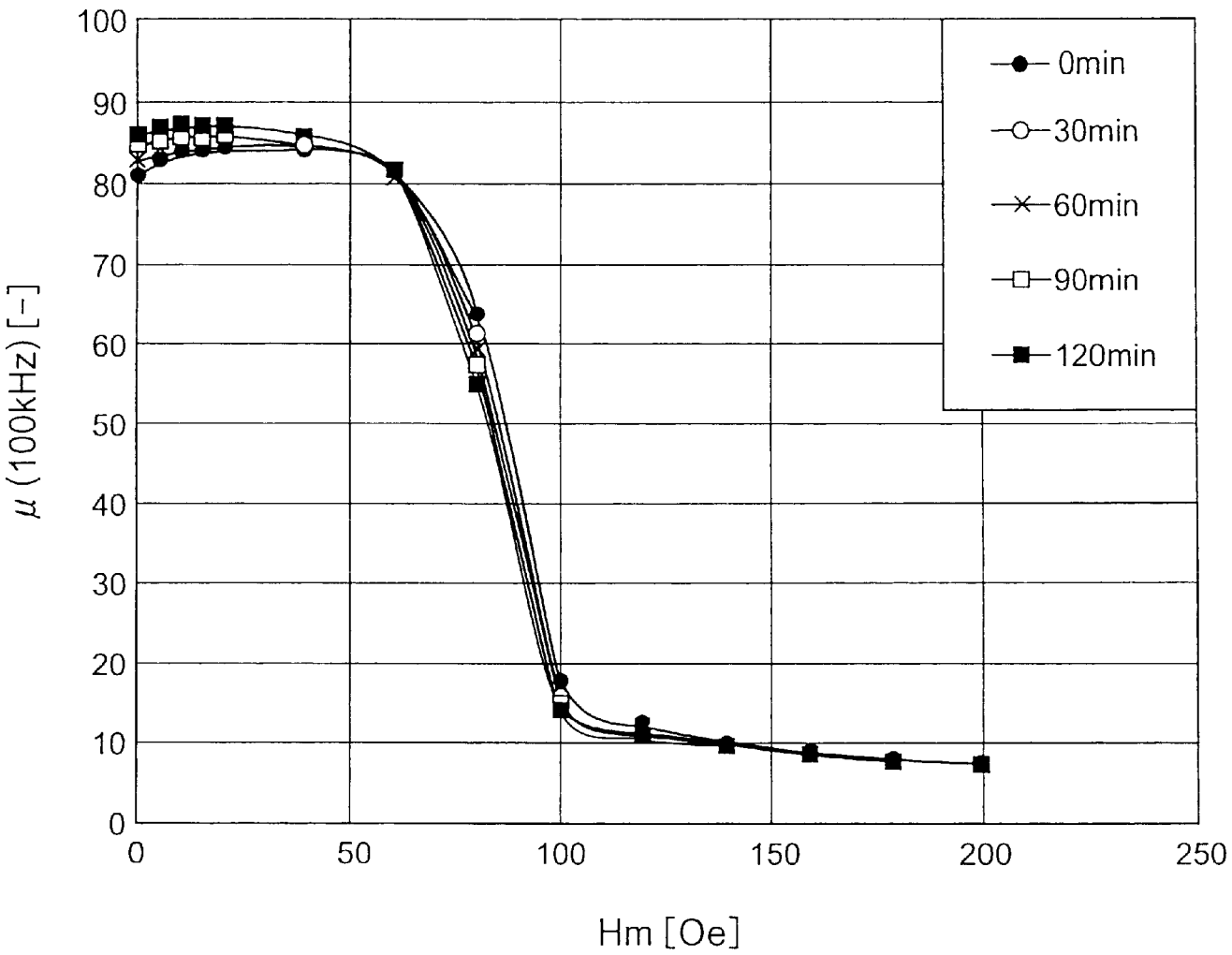
FIG. 24 graphically shows measured data of a DC superposition characteristic in the fifth embodiment of this invention in a case where the magnetic powder is covered with 3.0 vol % zinc.
Figure 25:
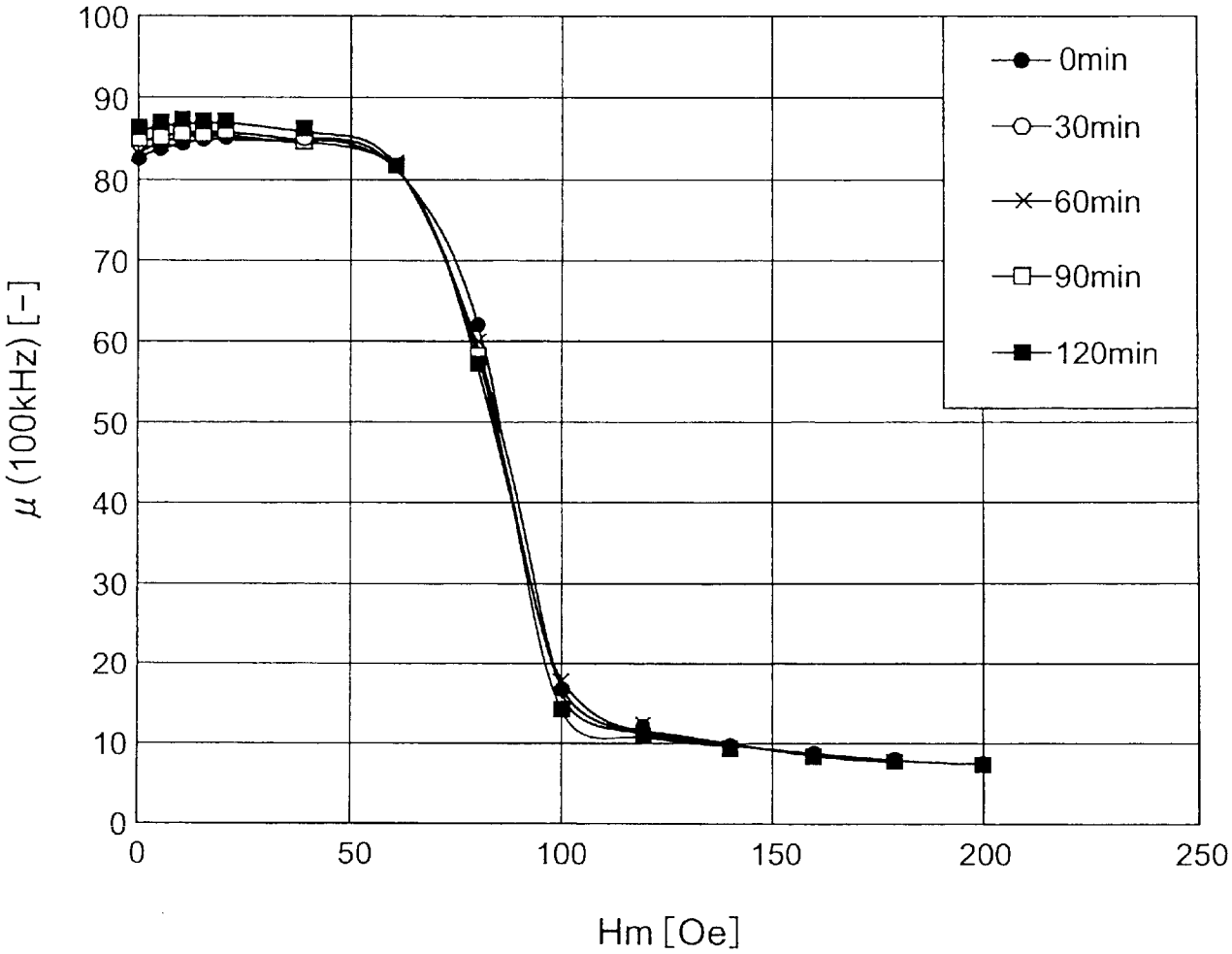
FIG. 25 graphically shows measured data of a DC superposition characteristic in the fifth embodiment of this invention in a case where the magnetic powder is covered with 5.0 vol % zinc.
Figure 26:
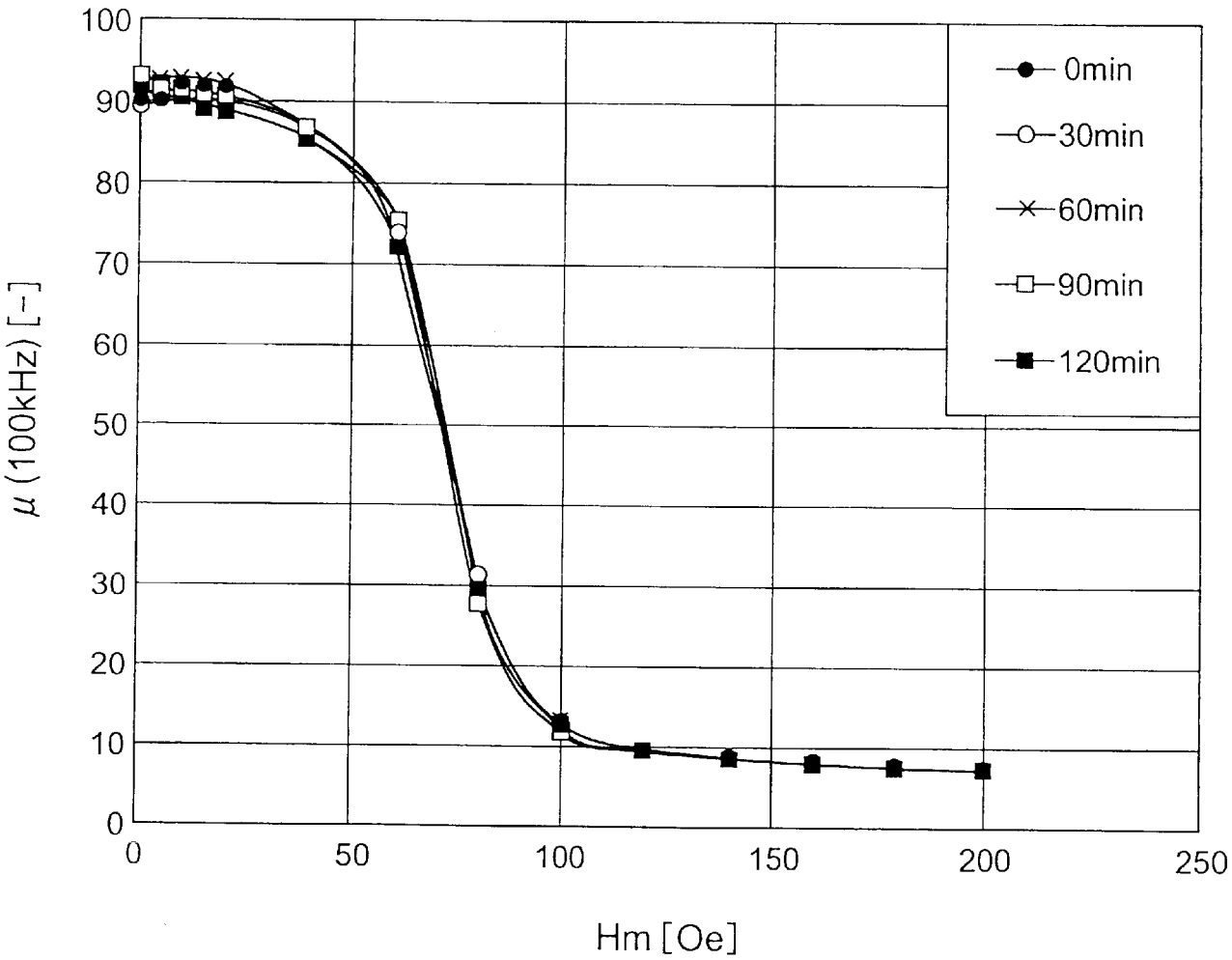
FIG. 26 graphically shows measured data of a DC superposition characteristic in the fifth embodiment of this invention in a case where the magnetic powder is covered with 10 vol % zinc.

The measured results are illustrated in FIGS. 21 through 27. FIG. 21 shows the DC superposition characteristics of the core inserted with the bond magnet comprising the magnetic powder consisting of an aggregation of magnetic particles surfaced with no coating. FIGS. 22–27 show the DC superposition characteristics of the cores inserted with the respective bond magnets comprising the magnetic powder consisting of an aggregation of magnetic particles surfaced with coatings of zinc by 0.1 vol %, 1.0 vol %, 3.0 vol %, 5.0 vol %, 10 vol %, and 15 vol %, respectively.

As is apparent from FIG. 21, in the core inserted with the bond magnet comprising the magnetic powder consisting of an aggregation of magnetic particles surfaced with no coating, the magnetic permeability was shifted toward a lower magnetic field side with increase of a heat treatment time interval and was drastically degraded. In comparison with this, as shown in FIGS. 22–27, in the cores inserted with the respective magnets each comprising the magnetic powder consisting of an aggregation of magnetic particles surfaced with a coating of zinc, it is understood that a degradation rate in heat treatment was always very small. It may be supposed that oxidation of the magnetic powder is suppressed due to a coating of zinc.

Figure 27:
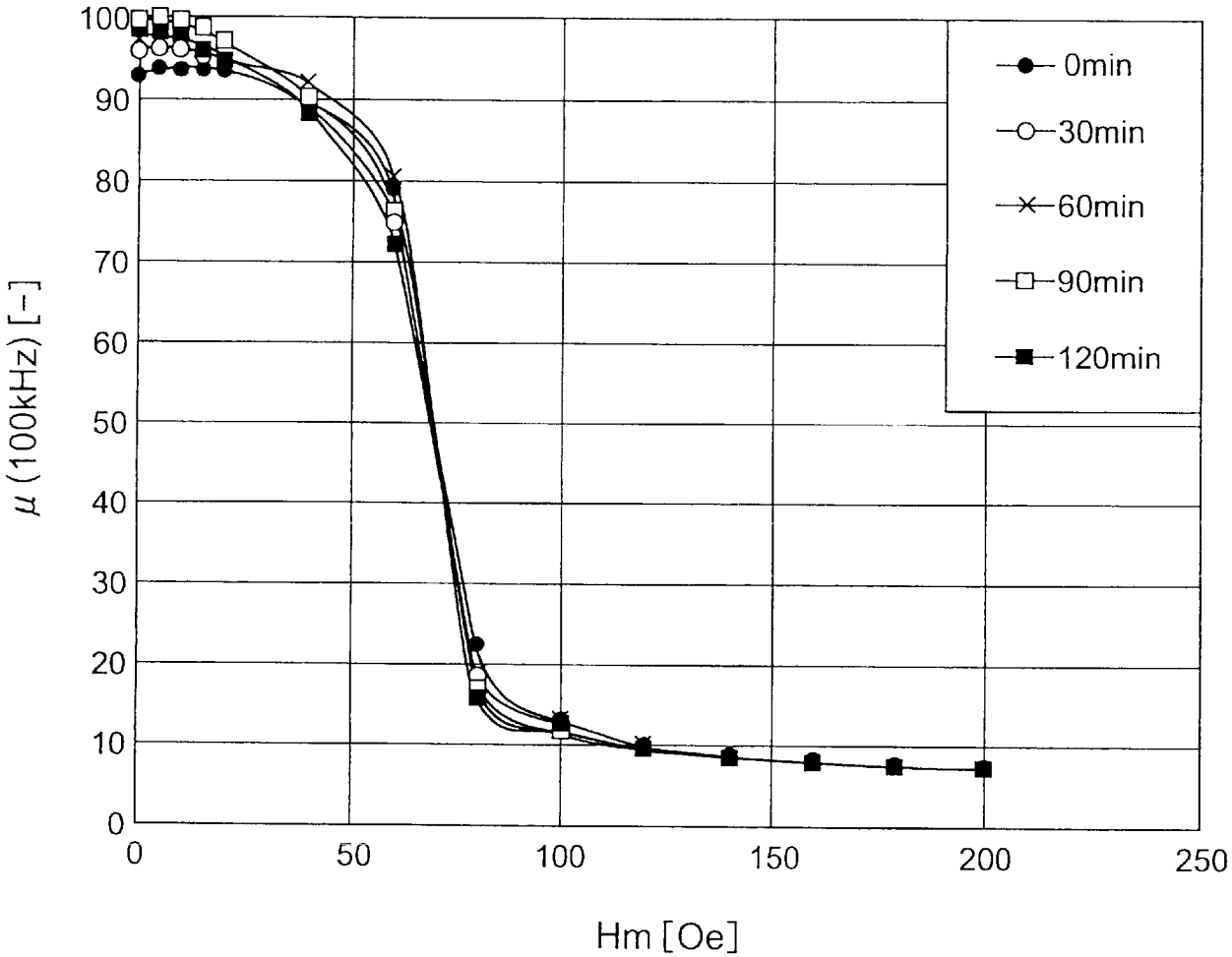
FIG. 27 graphically shows measured data of a DC superposition characteristic in the fifth embodiment of this invention in a case where the magnetic powder is covered with 15 vol % zinc.

In addition, as shown in FIG. 27, in the magnetic core inserted with the bond magnet comprising the magnetic powder consisting of an aggregation of magnetic particles surfaced with a coating of 15 vol % zinc, it is understood that magnetic permeability of the magnetic core did not extend to a higher magnetic field side and magnitude of a biasing magnetic field due to the magnet was very small in comparison with others. This may be thought that a rate of the magnetic powder decreases caused by increase of an amount of zinc or magnitude of the magnetization decreases because the magnetic powder and zinc reacts to each other.

Frequency characteristics were measured by the use of an impedance analyzer of 4194A made by Yokokawa Hewlett Packard in a range between AC magnetic field frequencies of 1 kHz and 15 MHz. Those results are shown in FIGS. 28 through 34.

Figure 28:
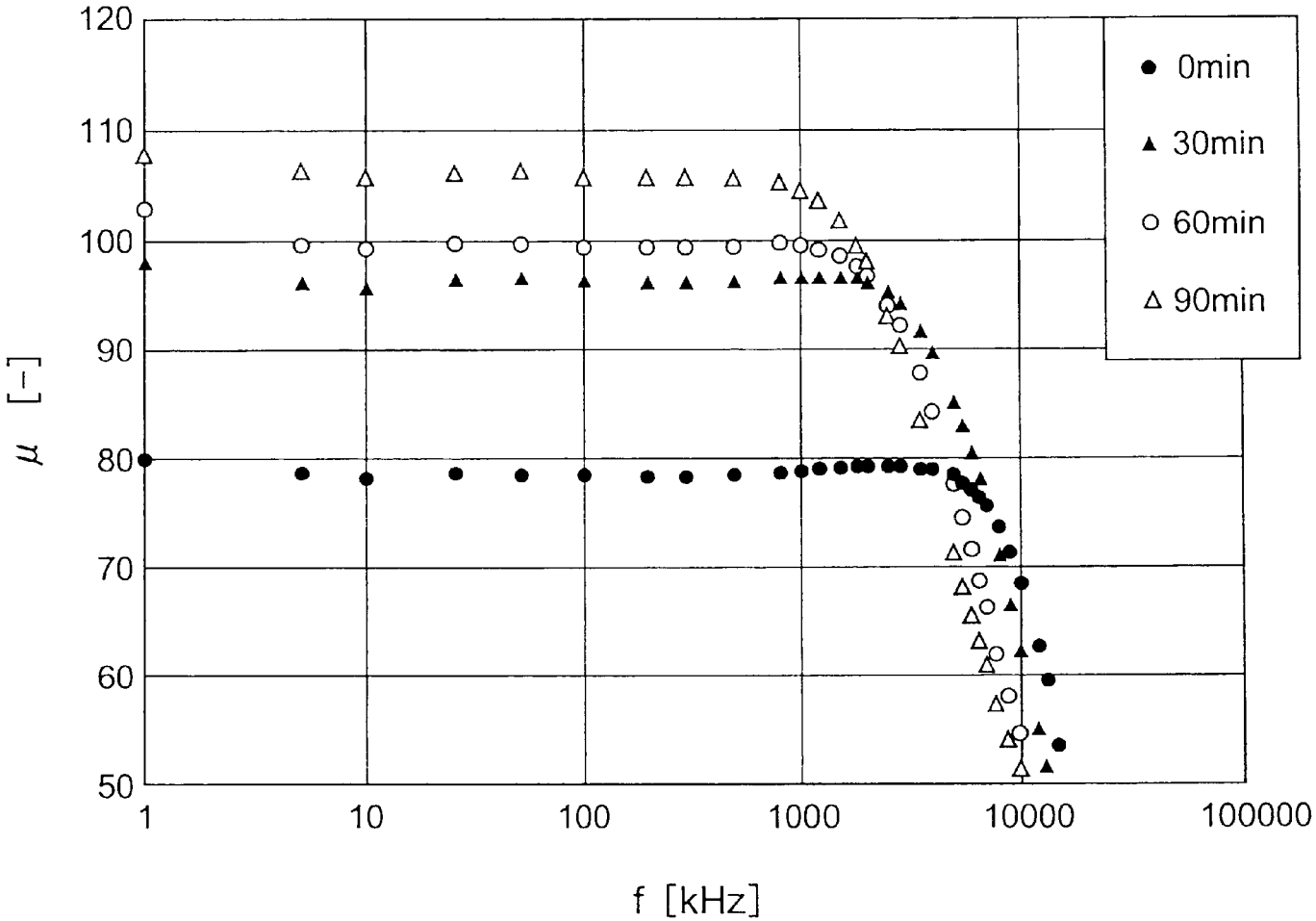
FIG. 28 graphically shows measured data of a frequency characteristic of magnetic permeability in a magnetic core according to the fifth embodiment of this invention in a case where the magnetic powder is uncovered with any covering metal.
Figure 29:
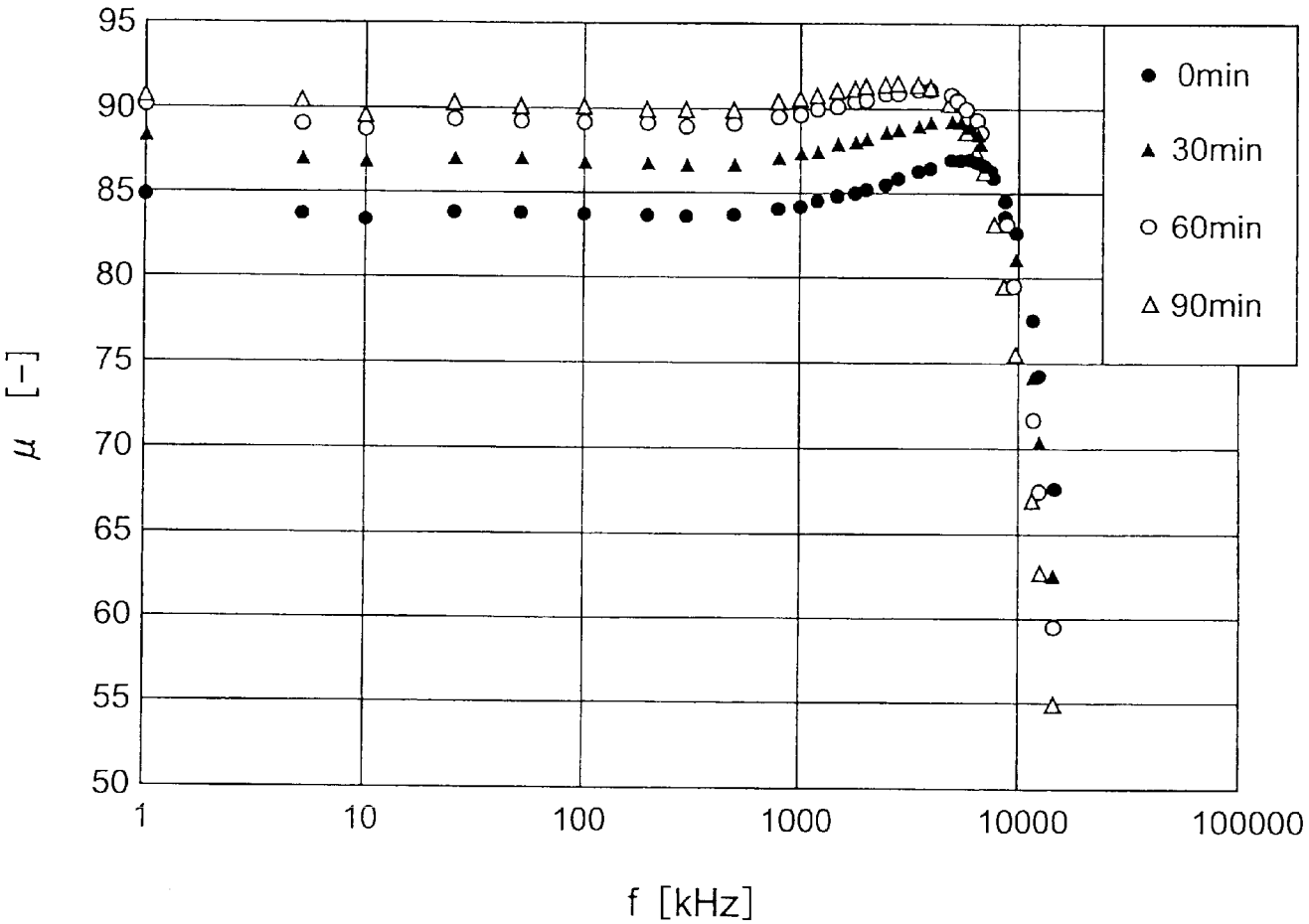
FIG. 29 graphically shows measured data of a frequency characteristic of magnetic permeability in a magnetic core according to the fifth embodiment of this invention in a case where the magnetic powder is covered with 0.1 vol % zinc.
Figure 30:
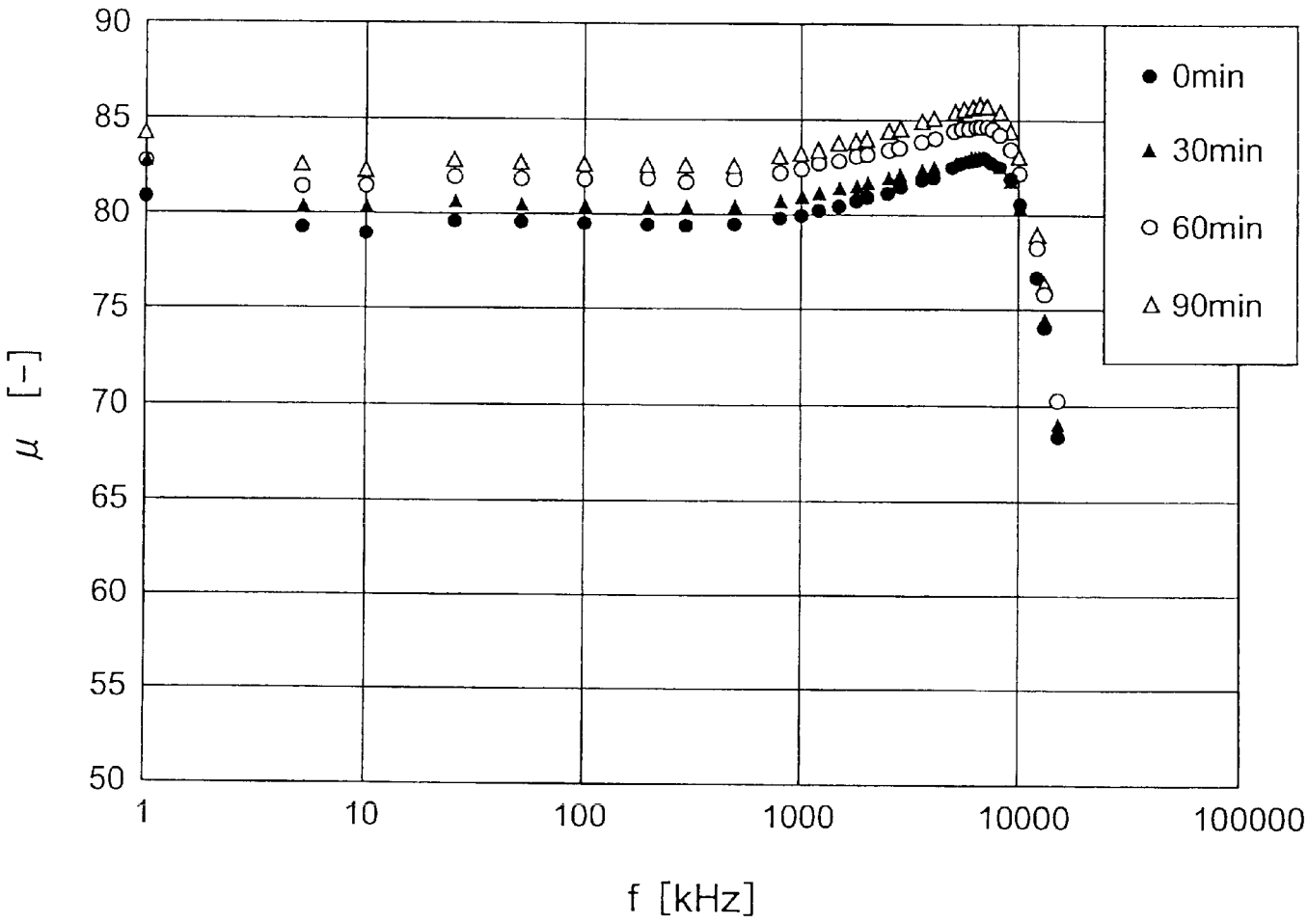
FIG. 30 graphically shows measured data of a frequency characteristic of magnetic permeability in a magnetic core according to the fifth embodiment of this invention in a case where the magnetic powder is covered with 1.0 vol % zinc.
Figure 31:
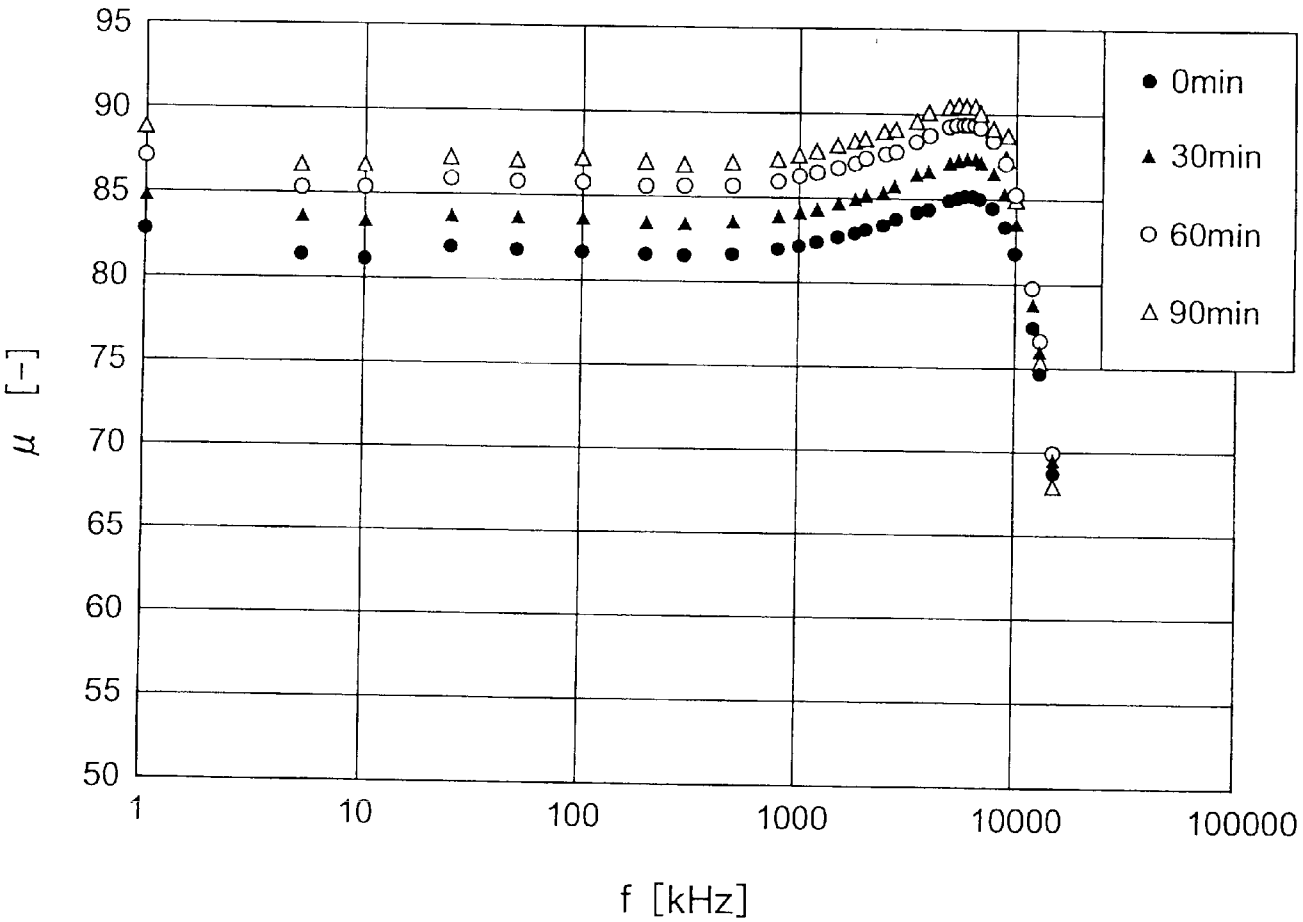
FIG. 31 graphically shows measured data of a frequency characteristic of magnetic permeability in a magnetic core according to the fifth embodiment of this invention in a case where the magnetic powder is covered with 3.0 vol % zinc.
Figure 32:
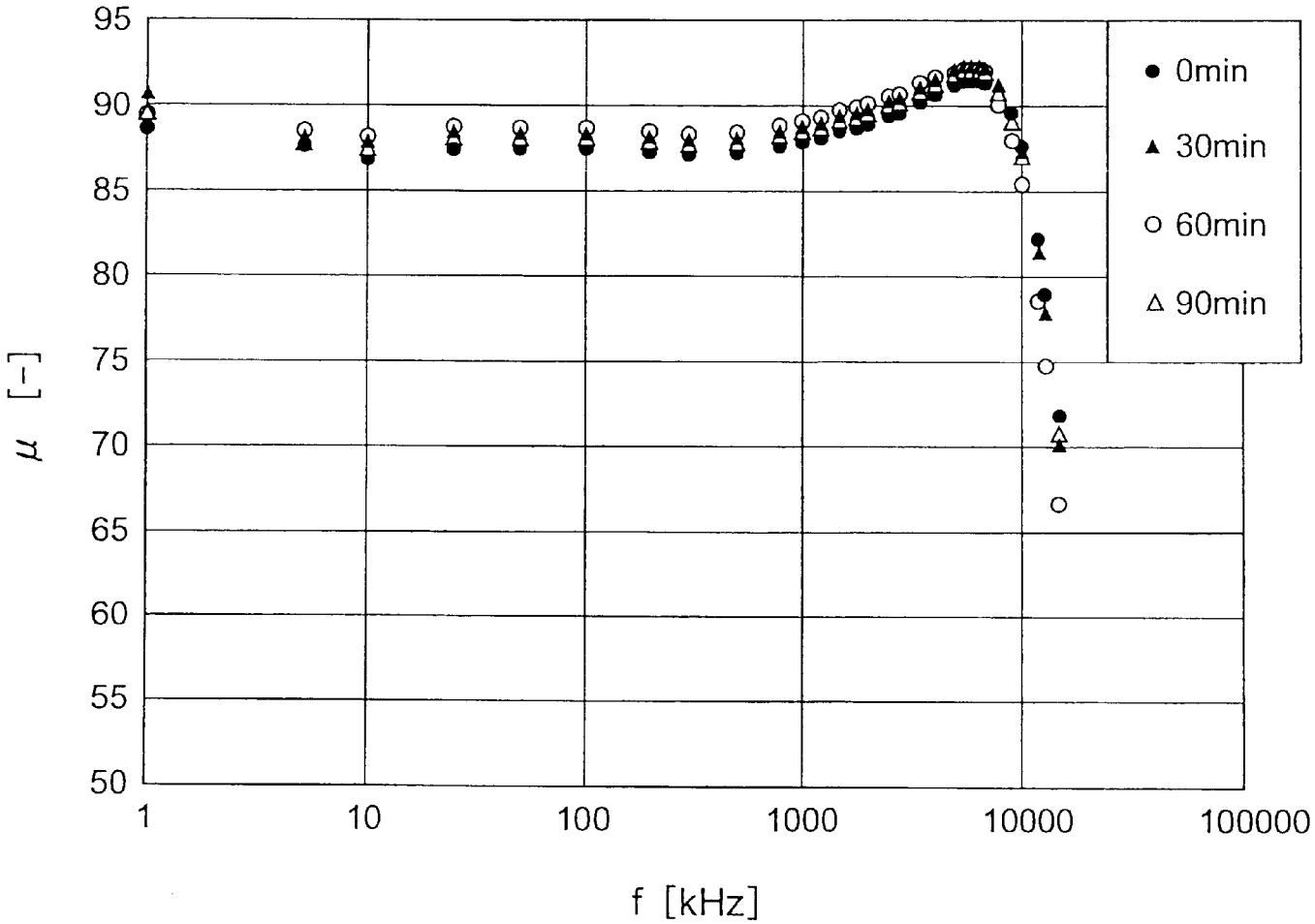
FIG. 32 graphically shows measured data of a frequency characteristic of magnetic permeability in a magnetic core according to the fifth embodiment of this invention in a case where the magnetic powder is covered with 5.0 vol % zinc.
Figure 33:
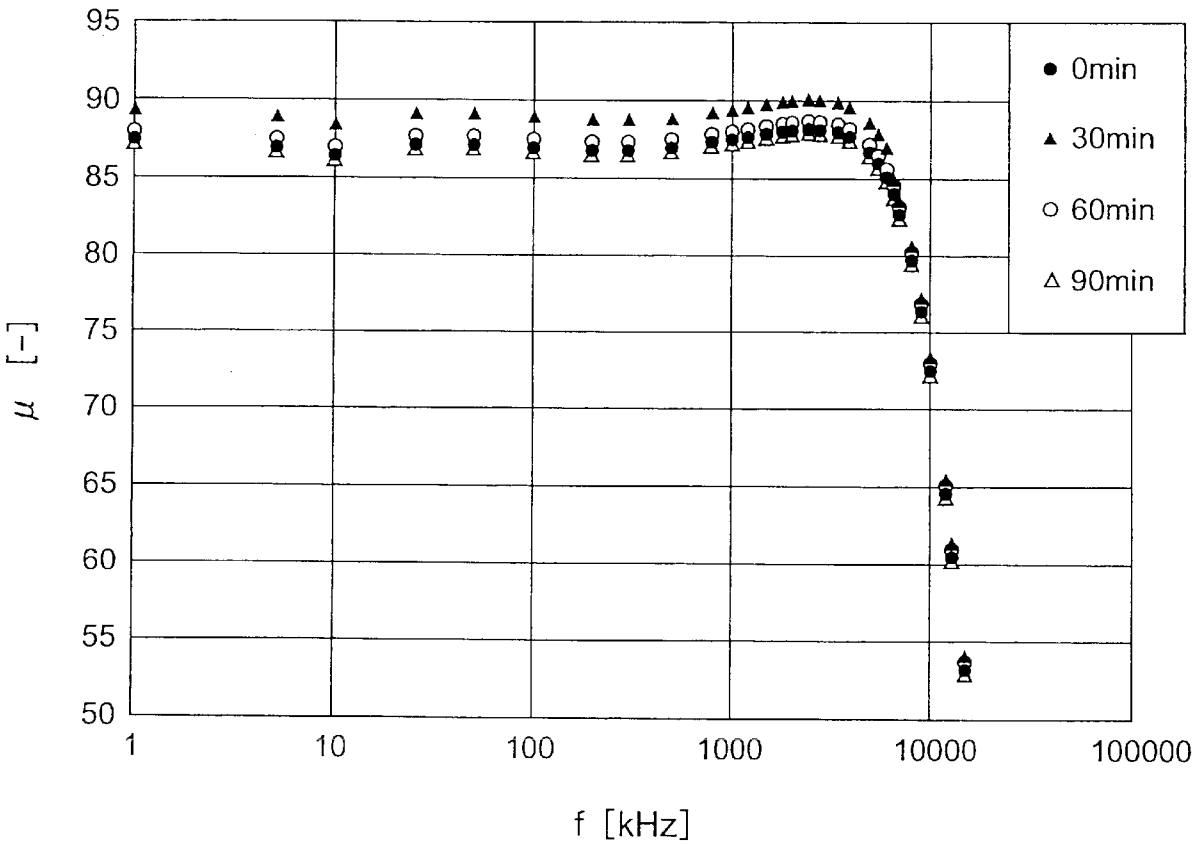
FIG. 33 graphically shows measured data of a frequency characteristic of magnetic permeability in a magnetic core according to the fifth embodiment of this invention in a case where the magnetic powder is covered with 10 vol % zinc.

As is apparent from FIG. 28, in the magnetic core inserted with the bond magnet comprising the magnetic powder consisting of an aggregation of magnetic particles surfaced with no coating, it is understood that the frequency characteristics were shifted to a lower frequency side with increase of a heat treatment time interval and were drastically degraded in the similar manner as the DC superposition characteristics. In comparison with this, as shown in FIGS. 29–34, in the magnetic cores inserted with the respective bond magnets each comprising the magnetic powder consisting of an aggregation of magnetic particles surfaced with a coating of zinc, it is understood that a degradation rate in heat treatment was very small. This may be supposed that oxidation of the magnetic powder is suppressed due to a coating of zinc.

Figure 34:
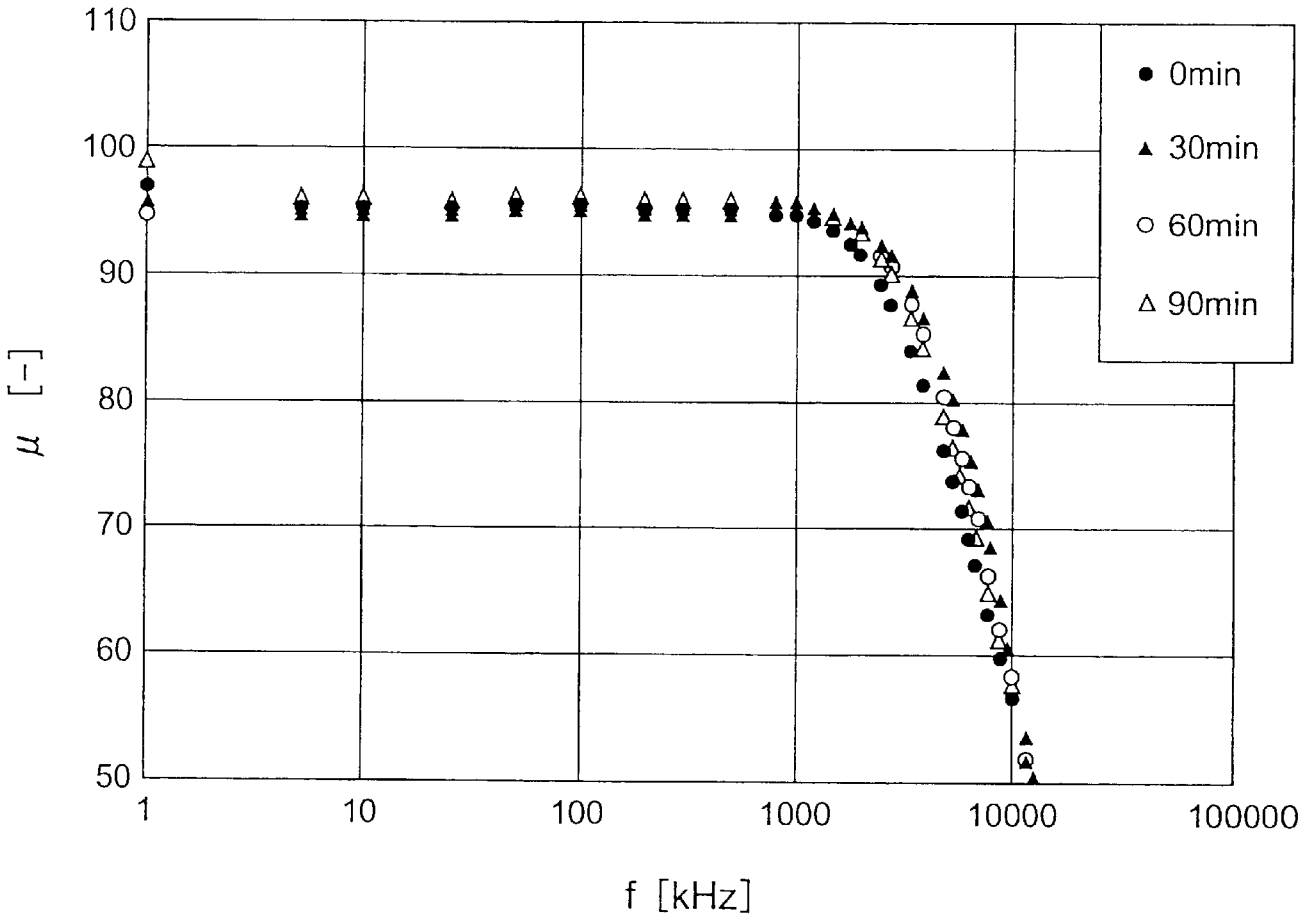
FIG. 34 graphically shows measured data of a frequency characteristic of magnetic permeability in a magnetic core according to the fifth embodiment of this invention in a case where the magnetic powder is covered with 15 vol % zinc.

In addition, as shown in FIG. 34, in the magnetic core inserted with the bond magnet comprising the magnetic powder consisting of an aggregation of magnetic particles surfaced with a coating of 15 vol % zinc, it is understood that magnetic permeability of the magnetic decreases in a lower frequency side although the degradation rate in the heat treatment is small. This may be supposed that a specific resistance decreases caused by increase of an amount of zinc and as a result, an eddy-current loss increases and the frequency characteristics are degraded.

For the above-mentioned reasons it is understood that the ferrite core has a very excellent characteristic when the amount of Zn used as a coating lies in a range of 0.1–10 vol %.

(Sixth Embodiment)

A magnetic core according to a sixth embodiment of this invention used, as a magnetically biasing bond magnet, a Sm—Co bond magnet comprising magnetic powder consisting of an aggregation of magnetic particles surfaced with a coating of a combination of metal and glass solder. In addition, magnetic flux characteristics and specific resistance of the Sm—Co bond magnet were measured. In a ferrite core of Mn—Zn series having a magnetic path with a magnetic gap in which the Sm—Co bond magnet is inserted, DC superposition characteristics and frequency characteristics of effective magnetic permeability u were measured and compared.

More specifically, such as a Sm—Co bond magnet was made as follows. As materials, Sm—Co magnetic powder having an average particle size of about 5 $\mu$m and Zn metal powder having an average particle size of about 5 $\mu$m were used. The Sm—Co magnetic powder was mixed with the Zn metal powder by 3 vol % and then was subjected to heat treatment at temperature of 500° C. for two hours in an atmosphere of argon. Zinc has a melting point of 419.5° C. Thereafter, the magnetic powder was mixed with, as low-melting glass powder, ZnO—$B_2O_3$—PbO having a softening point of about 400° C. and $B_2O_3$—PbO having a softening point of about 410° C. by 3 vol % and then was subjected to heat treatment at temperature of 400° C and 410° C. for two hours in an atmosphere of argon, respectively.

Thereafter, each resultant magnetic powder was mixed with, as binder resin, epoxy resin having an amount corresponding to 50 vol % in a total volume, and was then formed using a die in no magnetic field to obtain respective bond magnets.

The ferrite core used in experiment was, as shown in FIG. 3A, the EE core 2 which is made of a ferrite material of Mn—Zn series and which has a magnetic path of 7.5 cm and has an effective cross-sectional area of 0.74 $cm^2$. The EE core 2 comprises a central magnetic leg with a magnetic gap of 1.5 mm. Subsequently, the respective bond magnets made above were formed so as to have a cross section equal to that of the central magnetic leg of the ferrite core and to have a height of 1.5 mm and were magnetized in a direction of the magnetic path by the use of a pulse magnetizing machine in magnetic field of about 10 T. And, the above made bond magnet 1 was inserted in a gap portion of the above EE core 2 to make the magnetic core as shown in FIG. 3A.

In this event, the magnetic flux and the specific resistance of the bond magnets were measured single substance by single substance. Each measured sample was kept for thirty minutes in a thermostatic chamber at a temperature of 270° C. which is a temperature condition for a reflow soldering furnace, then cooled to the room temperature and left at the room temperature for two hours. The magnetic flux and the specific resistance of the bond magnets after reflow treatment were measured single substance by single substance. In addition, as a control, a bond magnet comprising Sm—Co magnetic powder consisting of an aggregation of magnetic particles surfaced with a coating of only zinc was made and magnetic flux and specific resistance of the bond magnet was measured as a single substance. Those results are illustrated in Tables 7 and 8. Furthermore, for each sample, a demagnetizing factor of the magnetic flux was measured before and after a reflow treatment. This measured results are illustrated in Table 7.

TABLE 7

| | Examples | | |
|---|---|---|---|
| Flux | Zn + (ZnO—$B_2O_3$—PbO) | Zn + ($B_2O_3$—PbO) | Control Zn |
| Before reflow treatment (G) | 195.2 | 192.4 | 198.3 |
| After reflow treatment (G) | 193.8 | 190.3 | 193.7 |
| Demagnetizing factor (%) | 99.3 | 98.9 | 97.7 |

TABLE 8

| | Examples | | |
|---|---|---|---|
| Specific resistance | Zn + (ZnO—$B_2O_3$—PbO) | Zn + ($B_2O_3$—PbO) | Control Zn |
| Before reflow treatment (Ω · cm) | 2.88 | 2.72 | 0.98 |
| After reflow treatment (Ω · cm) | 2.90 | 2.73 | 1.05 |

As is apparent from Table 8, it is understood that the bond magnets (examples) each comprising the magnetic powder consisting of an aggregation of magnetic particles surfaced with a coating of the combination of zinc and glass solder have a remarkably improved specific resistance in comparison with the bond magnet (control) comprising the magnetic powder consisting of an aggregation of magnetic particles surfaced with a coating of only zinc. In addition, as is apparent from Table 7, it is understood that the bond magnets (examples) each comprising the magnetic powder consisting of an aggregation of magnetic particles surfaced with a coating of the combination of zinc and glass solder have an improved demagnetizing factor of the magnetic flux after a reflow treatment in comparison with the bond magnet (control) comprising the magnetic powder consisting of an aggregation of magnetic particles surfaced with a coating of only zinc.

Figure 35:
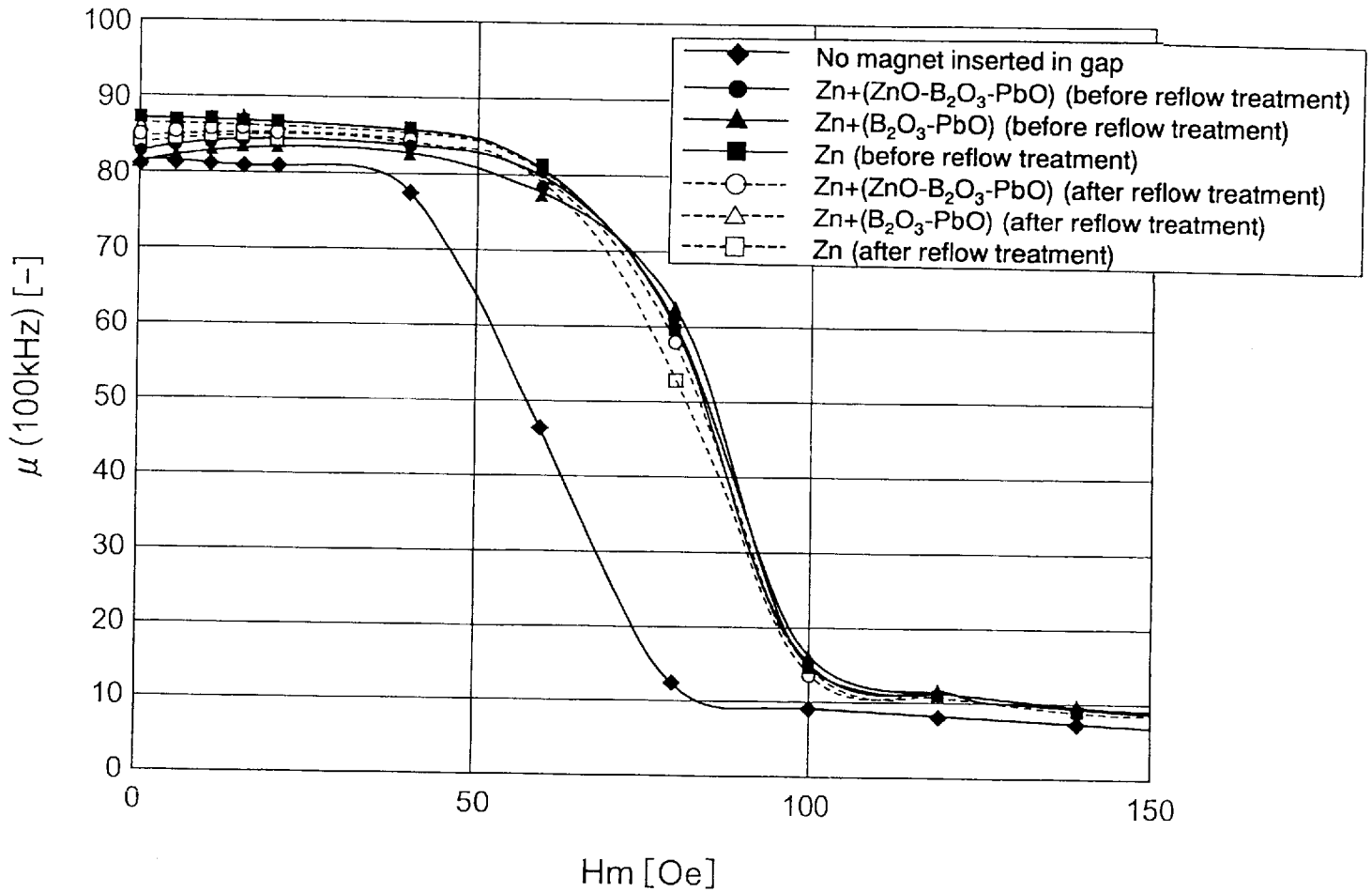
FIG. 35 graphically shows measured data of variations in DC superposition characteristics of a control and of examples in a sixth embodiment of this invention.
Figure 36:
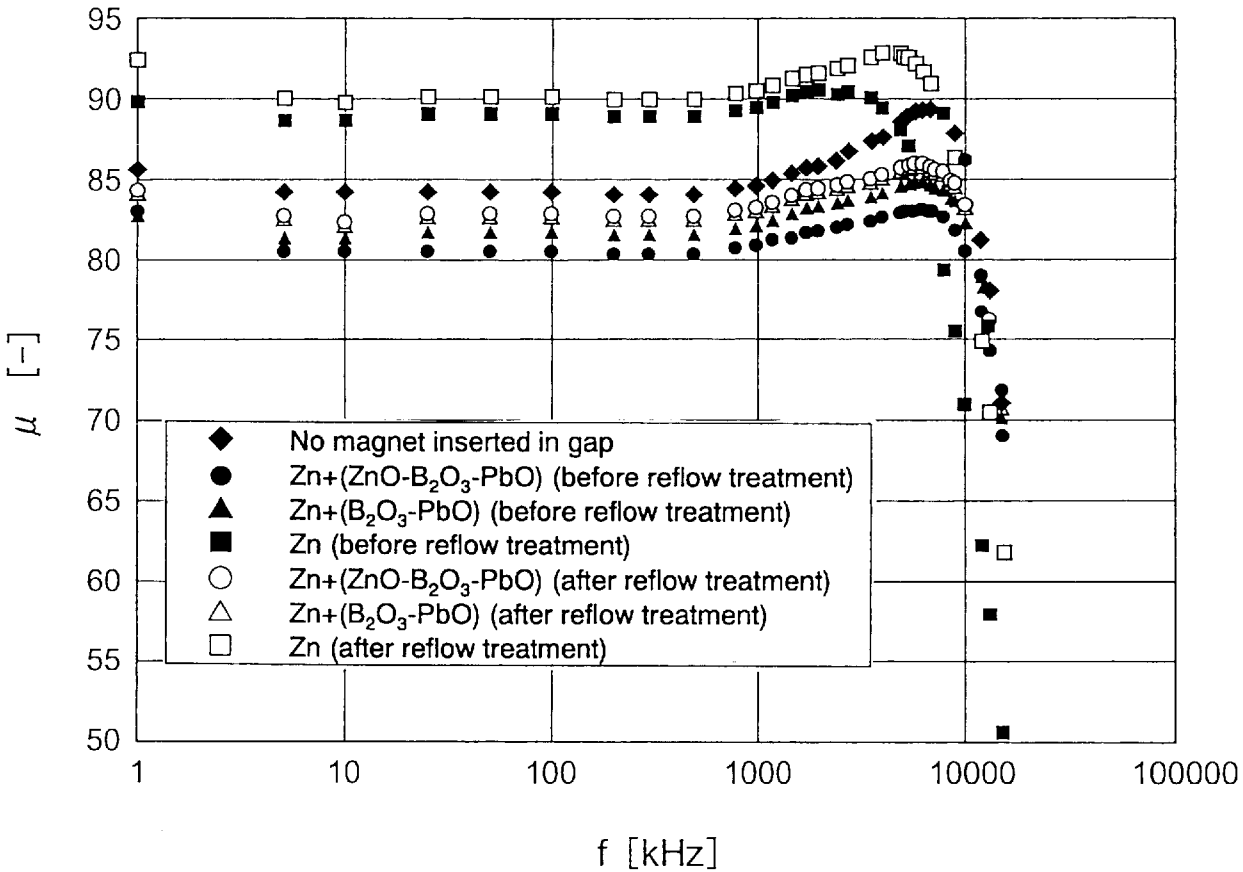
FIG. 36 graphically shows measured data of frequency characteristics in effective magnetic permeability of a control and of examples in the sixth embodiment of this invention.

Now, as shown in FIG. 3B, the coil 3 was wound around such a made magnetic core (FIG. 3A) to obtain an inductance part. The coil 3 was applied with a voltage with an alternating current (100 kHz) superimposed on a direct current to measure the DC superposition characteristics by use of an LCR meter and to calculate an effective magnetic permeability $\mu$ on the basis of a core constant (core size) and the number of winding of the coil 3. The calculated results are shown in FIG. 35. In this event, a superposition current is applied so that a direction of DC biasing magnetic field faces in the opposite direction of a direction of the magnetization of the magnetized magnet on insertion. In addition, a frequency characteristic of the effective magnetic permeability $\mu$ was measured by use of an impedance analyzer of 4194A made by Yokokawa Hewlett Packard. This result is shown in FIG. 36. Furthermore, a value of $\mu$10 MHz/$\mu$ 10 kHz was calculated on the basis of this frequency characteristic and is illustrated in Table 9. In the manner which is described above, each measured sample was kept for thirty minutes in a thermostatic chamber at a temperature of 270° C. which is a temperature condition for a reflow soldering furnace, then cooled to the room temperature and left at the room temperature for two hours. Thereafter, the bond magnet was inserted in a gap portion of the ferrite core (EE core)

and the coil was wound around the core. In the manner which is described above, the DC superposition characteristics, the frequency characteristic of the effective magnetic permeability $\mu$, and the value of $\mu$10 MHz/$\mu$10 kHz were measured and those measured results are shown and illustrated in FIGS. 35 and 36 and Table 9. Furthermore, as controls, a bond magnet comprising Sm—Co magnetic powder consisting of magnetic particles surfaced with a coating of zinc and a sample where the ferrite core has the gap portion with nothing inserted were made in the manner which is described above and DC superposition characteristics, the frequency characteristic of the effective magnetic permeability $\mu$, and the value of $\mu$10 MHz/$\mu$10 kHz were measured. Those measure results are also shown and illustrated in FIGS. 35 and 36 and Table 9.

TABLE 9

| | Examples | | | |
|---|---|---|---|---|
| $\mu$ 10 MHz/ | Zn + | Zn + | Control | |
| $\mu$ 10 kHz | (ZnO—$B_2O_3$—PbO) | ($B_2O_3$—PbO) | Zn | Air Gap |
| Before reflow treatment (%) | 100.3 | 101.0 | 80.4 | 102.3 |
| After reflow treatment (%) | 101.1 | 101.1 | 92.6 | 102.3 |

As is apparent from Table 9, it is understood that the effective magnetic permeability $\mu$ in the magnetic cores inserted with the respective bond magnets each comprising the magnetic powder consisting of an aggregation of magnetic particles surfaced with a coating of the combination of zinc and glass solder is an improved frequency characteristic in comparison with that of the magnetic core inserted with the bond magnet comprising the magnetic powder consisting of an aggregation of magnetic particles surfaced with a coating of zinc alone.

As described above, it is understood that it is possible for the sixth embodiment of this invention to obtain the magnetic core having a high specific resistance and a good demagnetizing factor.

Although zinc is selected as oxidation-resistant metal powder in the sixth embodiment of this invention, any of other oxidation-resistant metals may be used. For example, it may be easily supposed that it is possible to obtain similar merits in a case of using, as the oxidation-resistant metal, one metal or alloy thereof selected from a group of aluminum, bismuth, gallium, indium, magnesium, lead, antimony, and tin. In addition, although ZnO—$B_2O_3$—PbO and $B_2O_3$—PbO are used as the low-melting glass in the sixth embodiment of this invention, similar merits may be obtained in a case of using, as the low-melting glass, $K_2O$—$SiO_2$—PbO, $SiO_2$—$B_2O_3$—PbO, or the like.

(Seventh Embodiment)

A magnetic core according to a seventh embodiment of this invention also used, as a magnetically biasing bond magnet, a Sm—Co bond magnet in the manner as the above-mentioned sixth embodiment. More specifically, as materials of the bond magnet, Sm—Co magnetic powder having an average particle size of about 5 $\mu$m and Zn metal powder having an average particle size of about 5 $\mu$m were used in the similar manner which is described in the above-mentioned sixth embodiment of this invention. The Sm—Co magnetic powder was mixed with the Zn metal powder by 3 vol %, 5.0 vol %, and 7.0 vol %, respectively, and then was subjected to heat treatment at a temperature of 500° C. for two hours in an atmosphere of argon. Thereafter, the magnetic power was mixed with, as low-melting glass powder, ZnO—$B_2O_3$—PbO having a softening point of about 400° C. by 0 vol %, 1.0 vol %, 3.0 vol %, 5.0 vol %, 7.0 vol %, and 10.0 vol %, respectively, and then was subjected to heat treatment at a temperature of 400° C. for two hours in an atmosphere of argon, respectively.

Thereafter, each resultant magnetic powder was mixed with, as binder resin, epoxy resin having an amount corresponding to 50 vol % in a total volume, and was then formed using a die in no magnetic field to obtain respective bond magnets.

The respective bond magnets made above were formed so as to have a shape in a similar manner as the above-mentioned sixth embodiment of this invention and were magnetized by the use of a pulse magnetizing machine in magnetic field of about 10 T. Subsequently, for each of resultant bond magnets, in a similar manner as the above-mentioned sixth embodiment, magnetic flux was measured before and after a reflow treatment. The results are illustrated in Table 10.

TABLE 10

| | ZnO—$B_2O_3$—PbO | | | | | |
|---|---|---|---|---|---|---|
| | 0 vol % | 1 vol % | 3 vol % | 5 vol % | 7 vol % | 10 vol % |
| Before reflow treatment | | | | | | |
| 3 vol % Zn | 198.3 | 197.9 | 195.2 | 190.4 | 168.2 | 143.3 |
| 5 vol % Zn | 197.2 | 196.2 | 194.3 | 156.2 | 140.8 | 122.1 |
| 7 vol % Zn | 192.3 | 190.2 | 152.4 | 136.1 | 125.4 | 93.6 |
| After reflow treatment | | | | | | |
| 3 vol % Zn | 193.7 | 193.5 | 193.8 | 189.3 | 168.1 | 143.1 |
| 5 vol % Zn | 192.2 | 193.2 | 193.2 | 154.8 | 139.8 | 121.9 |
| 7 vol % Zn | 191.2 | 189.2 | 151.8 | 135.7 | 125.2 | 93.2 |

As is apparent from Table 10, it is understood that it is possible to obtain the bond magnet having an excellent characteristic of oxidation resistance when a total content of the Zn powder and the low-melting glass powder is 10 vol % or less on the base of a volumetric percentage. In addition, the co-inventors confirmed that the magnetic powder having the above-mentioned total content of 0.1 vol % or less on the base of a volumetric percentage was substantially identical with the bond magnet where only zinc is added.

In addition, although the seventh embodiment of this invention describes for the magnetic flux of the bond magnet alone, the co-inventors inserted the above-mentioned bond magnet 1 into the gap portion formed in the central leg of the ferrite core (EE core) 2 (FIG. 3A) in a similar manner as the above-mentioned sixth embodiment of this invention, wound the coil 3 around the core as shown in FIG. 3B, and measured the DC superposition characteristics. In this event, the co-inventors confirmed that the results corresponding to the magnetic flux were obtained and it is possible to obtain the bond magnet having an excellent characteristic of oxidation resistance when the total content of the Zn powder and the low-melting glass powder lies between 0.1 vol % and 10 vol %.

(Eighth Embodiment)

Now, illustration will be made about samples measured and compared frequency characteristic for effective magnetic permeability $\mu$ of a ferrite core of Mn—Zn series and magnetic flux of a Sm—Co bond magnet in a case where the Sm—Co bond magnet comprising magnetic power consisting of an aggregation of magnetic particles surfaced with a coating of both of zinc and a low-melting glass (ZnO—$B_2O_3$—PbO, $B_2O_3$—PbO) is inserted in a part of a magnetic path of the ferrite core of Mn—Zn series.

More specifically, the bond magnet was made as follows. First, Sm—Co magnetic powder having an average particle size of about 3 μm was mixed with Zn metal powder by 3 vol %, and then was subjected to heat treatment at a temperature of 500° C. for three hours in an atmosphere of argon. Thereafter, the magnetic power was mixed with, as low-melting glass powder, ZnO—$B_2O_3$—PbO having a softening point of about 400° C. and $B_2O_3$—PbO having a softening point of about 410° C. by 3 vol %, respectively, and then were subjected to heat treatment at a temperature of 420° C. in an atmosphere of argon.

Thereafter, each resultant magnetic powder was mixed with, as binder resin, polyamideimide resin having an amount corresponding to 40 vol % in a total volume, was stirred using a hybrid mixer, thereafter formed a bond magnet sheet having a thickness of about 150 μm using a doctor blade method, and then dried at a temperature of 200° C. for thirty minutes.

A ferrite core used in experiment was, as shown in FIG. 3A, the EE core 2 which is made of the ferrite material of Mn—Zn series and which has a magnetic path of 5.93 cm and has an effective cross-sectional area of 0.83 $cm^2$. The EE core 2 comprises a central magnetic leg with a magnetic gap of 200 μm. Subsequently, the respective bond magnets made above were formed so as to have a cross section equal to that of the central magnetic leg of the ferrite core and to have a height of 200 μm and thereafter were magnetized in a direction of the magnetic path by the use of a pulse magnetizing machine in magnetic field of about 10 T. And, the above made bond magnet 1 was inserted in a gap portion of the above EE core 2 to make the magnetic core as shown in FIG. 3A.

Figure 37:
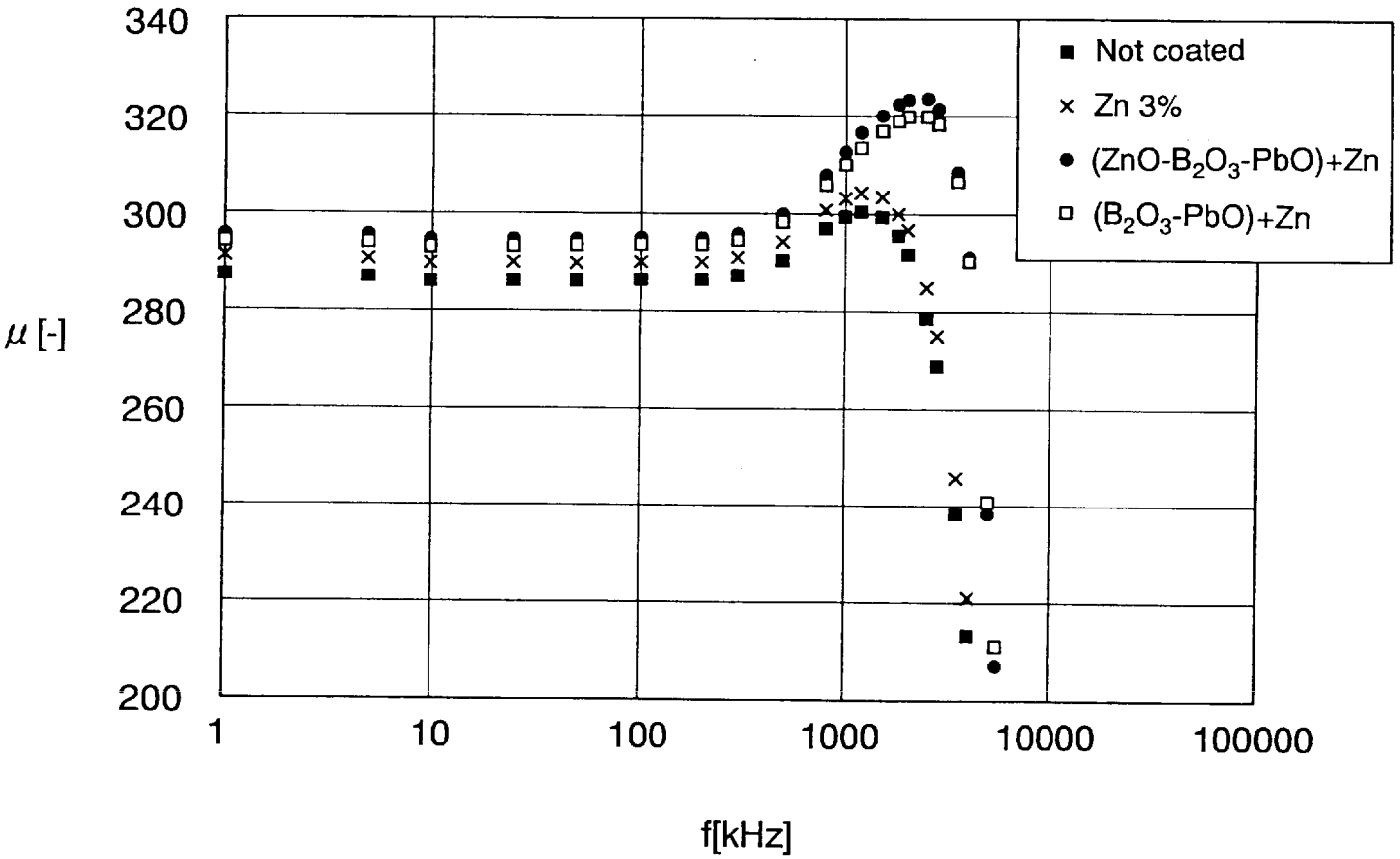
FIG. 37 graphically shows measured data of frequency characteristics in effective magnetic permeability of a control and of examples in an eighth embodiment of this invention.

Table 11 shows specific resistance, core-loss values, demagnetizing factor on carrying out heat treatment for thirty minutes at an atmosphere of air of the Sm—Co bond magnet sheet comprising the magnetic powder consisting of an aggregation of magnetic particles surfaced with a coating of both of zinc and the low-melting glass (ZnO—$B_2O_3$—PbO, $B_2O_3$—PbO). In addition, FIG. 37 illustrates the frequency characteristic of the effective magnetic permeability μ when the bond magnet is inserted in the magnetic core.

TABLE 11

| | Specific resistance (Ω · cm) | Demagnetizing factor (%) | loss (kW/$m^3$) 100 mT, 100 kHz | loss (kW/$m^3$) 50 mT, 200 kHz |
|---|---|---|---|---|
| No coating | 0.15 | 17.0 | 370.0 | 230.0 |
| 3 vol % Zn | 0.12 | 2.0 | 390.8 | 250.5 |
| 3 vol % (ZnO—$B_2O_3$—PbO) + 3 vol % Zn | 1.85 | 1.5 | 240.6 | 200.5 |
| 3 vol % ($B_2O_3$—PbO) + 3 vol % Zn | 1.65 | 1.2 | 256.0 | 198.5 |

As is apparent from Table 11, it is understood that the sample with no coating has a bad specific resistance and a bad demagnetizing factor. In addition, it seems that the sample with a coating of zinc alone still has a low specific resistance although it has a lower demagnetizing factor in comparison with that of the sample with no coating. Furthermore, it is seen that the samples with a coating of both of zinc and the low-melting glass (ZnO—$B_2O_3$—PbO, $B_2O_3$—PbO) have an enlarged specific resistance, a good demagnetizing factor, and a good core-loss in comparison with those of both of the sample with no coating and the sample with a coating of zinc alone.

In addition, as is apparent from FIG. 37, it is understood that the samples with a coating of both of zinc and the low-melting glass (ZnO—$B_2O_3$—PbO, $B_2O_3$—PbO) have an improved frequency characteristic for the effective magnetic permeability μ in comparison with those of both of the sample with no coating and the sample with a coating of zinc alone.

From the above-mentioned results, it seems that the magnetic core, which is inserted with the bond magnet comprising the magnetic powder consisting of an aggregation of magnetic particles surfaces with a coating of both of zinc and the low-melting glass (ZnO—$B_2O_3$—PbO, $B_2O_3$—PbO), has the oxidation resistance, an excellent core-loss characteristic, and an improved frequency characteristic for the effective magnetic permeability μ.

While this invention has thus far been described in conjunction with preferred embodiments thereof, it will now be readily possible for those skilled in the art to put this invention into various other manners. For example, although 12-nylone resin, epoxy resin, and polyamideimide resin are used as the binder resin in the above-mentioned embodiments, other resin may be used as the binder resin.

What is claimed is:

1. A magnetic core having at least one magnetic gap in a magnetic path thereof, said magnetic core comprising a magnetically biasing magnet disposed in the magnetic gap for providing a magnetic bias from opposite ends of the magnetic gap to the core, wherein:

said magnetically biasing magnet comprises a bond magnet which comprises rare-earth magnetic powder and a binder resin, said rare-earth magnetic powder having an intrinsic coercive force of 5 kOe or more, a Curie temperature of 300° C. or more, and an average particle size of 2.0–50 μm, and said rare-earth magnetic power consisting of an aggregation of magnetic particles surfaced with a coating of a metallic layer containing an oxidation-resistant metal.

2. A magnetic core as claimed in claim 1, wherein said oxidation-resistant metal is at least one metal or alloy thereof selected from a group of zinc, aluminum, bismuth, gallium, indium, magnesium, lead, antimony, and tin.

3. A magnetic core as claimed in claim 1 or 2, wherein said bond magnet comprises said binder resin content thereof which is 20% or more on the base of a volumetric percentage, said bond magnet having a specific resistance of 1 Ω·cm or more.

4. A magnetic core as claimed in claim 1 or 2, wherein said magnetic powder comprises said oxidation-resistant metal content thereof which is 0.1–10% on the base of a volumetric percentage.

5. A magnetic core as claimed in claim 1, wherein said binder resin is polyamideimide resin.

6. An inductance part which comprises the magnetic core as claimed in any one of claims 1, 2 or 5, and at least one winding wound by one or more turns on said magnetic core.

7. A magnetic core as claimed in claim 3, wherein said magnetic powder comprises said oxidation-resistant metal content thereof which is 0.1–10% on the base of a volumetric percentage.

8. A magnetic core as claimed in claim 3, wherein said binder resin is polyamideimide resin.

9. An inductance part which comprises the magnetic core as claimed in claim 3, and at least one winding wound by one or more turns on said magnetic core.

10. An inductance part which comprises the magnetic core as claimed in claim 4, and at least one winding wound by one or more turns on said magnetic core.

11. A magnetic core having at least one magnetic gap in a magnetic path thereof, said magnetic core comprising a magnetically biasing magnet disposed in the magnetic gap for providing a magnetic bias from opposite ends of the magnetic gap to the core, wherein:

said magnetically biasing magnet comprises a bond magnet which comprises rare-earth magnetic powder and a binder resin, said rare-earth magnetic powder having an intrinsic coercive force of 10 kOe or more, a Curie temperature of 500° C. or more, and an average particle size of 2.5–50 μm, and said rare-earth magnetic power consisting of an aggregation of magnetic particles surfaced with a coating of a metallic layer containing an oxidation-resistant metal.

12. A magnetic core as claimed in claim 11, wherein said oxidation-resistant metal is at least one metal or alloy thereof selected from a group of zinc, aluminum, bismuth, gallium, indium, magnesium, lead, antimony, tin.

13. A magnetic core as claimed in claim 11 or 12, wherein said bond magnet comprises said binder resin content thereof which is 30% or more on the base of a volumetric percentage, said bond magnet having a specific resistance of 1 Ω·cm or more.

14. A magnetic core as claimed in claim 11 or 12, wherein said magnetic powder comprises said oxidation-resistant metal content thereof which is 0.1–10% on the base of a volumetric percentage.

15. A magnetic core as claimed in claim 11, wherein said binder resin is polyamideimide resin.

16. An inductance part which comprises the magnetic core as claimed in any one of claims 11, 12 or 15, and at least one winding wound by one or more turns on said magnetic core.

17. A magnetic core as claimed in claim 13, wherein said magnetic powder comprises said oxidation-resistant metal content thereof which is 0.1–10% on the base of a volumetric percentage.

18. A magnetic core as claimed in claim 13, wherein said binder resin is polyamideimide resin.

19. An inductance part which comprises the magnetic core as claimed in claim 13, and at least one winding wound by one or more turns on said magnetic core.

20. An inductance part which comprises the magnetic core as claimed in claim 14, and at least one winding wound by one or more turns on said magnetic core.

21. A magnetic core having at least one magnetic gap in a magnetic path thereof, said magnetic core comprising a magnetically biasing magnet disposed in the magnetic gap for providing a magnetic bias from opposite ends of the magnetic gap to the core, wherein:

said magnetically biasing magnet comprises a bond magnet which comprises rare-earth magnetic powder and a binder resin, said rare-earth magnetic powder having an intrinsic coercive force of 10 kOe or more, a Curie temperature of 500° C. or more, and an average particle size of 2.5–50 μm, said bond magnet comprising said binder resin content thereof which is 30% or more on the base of a volumetric percentage, said bond magnet having a specific resistance of 1 Ω·cm or more, and said rare-earth magnetic power consisting of an aggregation of magnetic particles surfaced with a coating of a metallic layer containing an oxidation-resistant metal, said metallic layer being surfaced with a coating of a glass layer consisting of low-melting glass having a softening point which is lower than a melting point of said oxidation-resistant metal.

22. A magnetic core as claimed in claim 21, wherein said oxidation-resistant metal is at least one metal or alloy thereof selected from a group of zinc, aluminum, bismuth, gallium, indium, magnesium, lead, antimony, tin.

23. A magnetic core as claimed in claim 21 or 22, wherein said magnetic powder comprises said oxidation-resistant metal and said low-melting glass total content thereof which is 0.1–10% on the base of a volumetric percentage.

24. A magnetic core as claimed in claim 21, wherein said binder resin is polyamideimide resin.

25. An inductance part which comprises the magnetic core as claimed in any one of claims 21, 22 or 24, and at least one winding wound by one or more turns on said magnetic core.

26. An inductance part which comprises the magnetic core as claimed in claim 23, and at least one winding wound by one or more turns on said magnetic core.

27. A magnetically biasing magnet for use in a magnetic core having at least one magnetic gap in a magnetic path thereof, said magnetically biasing magnet being disposed in the magnetic gap for providing a magnetic bias from opposite ends of the magnetic gap to the core, wherein said magnetically biasing magnet comprises a bond magnet which comprises rare-earth magnetic powder and a binder resin, said rare-earth magnetic powder having an intrinsic coercive force of 10 kOe or more, a Curie temperature of 500° C. or more, and an average particle size of 2.5–50 μm, said bond magnet comprising said binder resin content thereof which is 30% or more on the base of a volumetric percentage, said bond magnet having a specific resistance of 1 Ω·cm or more, and said rare-earth magnetic power consisting of an aggregation of magnetic particles surfaced with a coating of a metallic layer containing an oxidation-resistant metal, said metallic layer being surfaced with a coating of a glass layer consisting of low-melting glass having a softening point which is lower than a melting point of said oxidation-resistant metal.

28. A magnetically biasing magnet as claimed in claim 27, wherein said oxidation-resistant metal is at least one metal or alloy thereof selected from a group of zinc, aluminum, bismuth, gallium, indium, magnesium, lead, antimony, tin.

29. A magnetically biasing magnet as claimed in claim 27 or 28, wherein said magnetic powder comprises said oxidation-resistant metal and said low-melting glass total content thereof which is 0.1–10% on the base of a volumetric percentage.

30. A magnetically biasing magnet as claimed in claim 27, wherein said binder resin is polyamideimide resin.

* * * * *